US006517175B2

(12) United States Patent
Kanaya et al.

(10) Patent No.: US 6,517,175 B2
(45) **Date of Patent: *Feb. 11, 2003**

(54) PRINTER, METHOD OF MONITORING RESIDUAL QUANTITY OF INK, AND RECORDING MEDIUM

(75) Inventors: Munehide Kanaya, Nagano-ken (JP); Shuji Yonekubo, Nagano-ken (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/305,745

(22) Filed: May 6, 1999

(65) Prior Publication Data

US 2002/0140748 A1 Oct. 3, 2002

(30) Foreign Application Priority Data

May 12, 1998 (JP) ..... 10-128781
Nov. 27, 1998 (JP) ..... 10-338010

(51) Int. Cl.[7] ..... B41J 2/195; B41J 29/393
(52) U.S. Cl. ..... 347/7; 347/19
(58) Field of Search ..... 347/7, 19, 15, 347/14

(56) References Cited

U.S. PATENT DOCUMENTS 5,068,806 A * 11/1991 Gatten
5,663,750 A * 9/1997 Sakuma
6,155,664 A * 12/2000 Cook ..... 347/7

FOREIGN PATENT DOCUMENTS

| | | | |
|---|---|---|---|
| EP | 0 585 560 | * | 3/1994 |
| EP | 0 593 282 | * | 4/1994 |
| EP | 0 703 084 | * | 3/1996 |
| FR | 2 737 150 | * | 1/1997 |
| JP | 9-136432 | | 5/1997 |

* cited by examiner

*Primary Examiner*—John Barlow
*Assistant Examiner*—Michael S Brooke
(74) *Attorney, Agent, or Firm*—Oblon, Spivak, McClelland, Maier & Neustadt, P.C.

(57) ABSTRACT

The technique of the present invention improves the accuracy of calculating an amount of ink consumption in an ink reservoir used in a printer, which ejects ink stored in the ink reservoir and prints an image. In the printer of the present invention, a weight of a single ink droplet is measured in advance under a preset reference condition. In the course of printing an image, the printer detects an ink supply condition, which affects the weight of a single ink droplet, and counts a number of ink droplets ejected. The amount of ink consumption is determined by correcting a product of the measured weight of a single ink droplet and the counted number of ink droplets based on a difference between the detected ink supply condition and the preset reference condition. This arrangement calculates the amount of ink consumption by taking into account the ink supply condition, thereby improving the accuracy of calculation for the amount of ink consumption.

25 Claims, 25 Drawing Sheets

| DRIVING DUTY | CORRECTION COEFFICIENT |
|---|---|
| 100% | 1.00 |
| 88% | 1.05 |
| 75% | 1.06 |
| 63% | 1.07 |
| 50% | 1.08 |
| 38% | 1.09 |
| 25% | 1.095 |
| 13% | 1.10 |

Fig. 20A

| | | RELATIVE DRIVING FREQUENCY | | |
|---|---|---|---|---|
| | | 100% | 50% | UNDER 33% |
| INK TEMPERATURE | 10℃ | 1.00 | 1.07 | 1.10 |
| | 10℃ ~25℃ | 1.00 | -0.07(T-25)/15 +1.00 | -0.1(T-25)/15 +1.00 |
| | 25℃ | 1.00 | 1.00 | 1.00 |
| | 25℃ ~40℃ | 1.00 | -0.08(T-25)/15 +1.00 | -0.11(T-25)/15 +1.00 |
| | 40℃ | 1.00 | 0.92 | 0.89 |

Fig. 20B

| DRIVING DUTY | CORRECTION COEFFICIENT |
|---|---|
| 100% | 1.00 |
| 88% | 1.05 |
| 75% | 1.06 |
| 63% | 1.07 |
| 50% | 1.08 |
| 38% | 1.09 |
| 25% | 1.095 |
| 13% | 1.10 |

Fig. 22A

| | SERIAL POSITIONS | | | | | | | | | | | | | | | |
|---|---|---|---|---|---|---|---|---|---|---|---|---|---|---|---|---|
| NOZZLE POSITIONS | 1 | 2 | 3 | 4 | 5 | 6 | 7 | 8 | 9 | 10 | 11 | 12 | 13 | 14 | 15 | 16 |
| 1 | 0 | 1 | 0 | 0 | 0 | 1 | 1 | 0 | 1 | 1 | 1 | 0 | 1 | 1 | 1 | 1 |
| 2 | 0 | 0 | 1 | 0 | 1 | 0 | 0 | 0 | 1 | 1 | 0 | 1 | 0 | 1 | 1 | 1 |
| 3 | 0 | 1 | 0 | 1 | 0 | 0 | 1 | 1 | 1 | 0 | 1 | 0 | 1 | 0 | 1 | 0 |
| 4 | 0 | 1 | 1 | 0 | 0 | 1 | 1 | 0 | 0 | 0 | 1 | 0 | 1 | 1 | 0 | 1 |
| 5 | 0 | 0 | 1 | 0 | 0 | 0 | 0 | 0 | 1 | 0 | 1 | 0 | 0 | 1 | 0 | 1 |
| 6 | 0 | 0 | 0 | 0 | 0 | 0 | 1 | 1 | 0 | 1 | 0 | 1 | 1 | 0 | 0 | 1 |
| 7 | 1 | 1 | 1 | 1 | 0 | 1 | 0 | 0 | 1 | 0 | 0 | 1 | 1 | 0 | 0 | 0 |
| 8 | 0 | 0 | 0 | 0 | 0 | 0 | 1 | 0 | 0 | 1 | 1 | 1 | 0 | 1 | 0 | 1 |

Fig. 22B

| | SERIAL POSITIONS | | | | | | | | | | | | | | | | SUMS OF CORRECTION COEFFICIENTS |
|---|---|---|---|---|---|---|---|---|---|---|---|---|---|---|---|---|---|
| NOZZLE POSITIONS | 1 | 2 | 3 | 4 | 5 | 6 | 7 | 8 | 9 | 10 | 11 | 12 | 13 | 14 | 15 | 16 | |
| 1 | 0 | 1.1 | 0 | 0 | 0 | 1.1 | 1 | 0 | 1.07 | 1 | 1 | 0 | 1.07 | 1 | 1 | 1 | 10.34 |
| 2 | 0 | 0 | 1.1 | 0 | 1.07 | 0 | 0 | 0 | 1.1 | 1 | 0 | 1.07 | 0 | 1.07 | 1 | 1 | 8.41 |
| 3 | 0 | 1.1 | 0 | 1.07 | 0 | 0 | 1.1 | 1 | 1 | 0 | 1.07 | 0 | 1.07 | 0 | 1.07 | 0 | 8.48 |
| 4 | 0 | 1.1 | 1 | 0 | 0 | 1.1 | 1 | 0 | 0 | 0 | 1.1 | 0 | 1.07 | 1 | 0 | 1.07 | 8.44 |
| 5 | 0 | 0 | 1.1 | 0 | 0 | 0 | 0 | 0 | 1.1 | 0 | 1.07 | 0 | 0 | 1.1 | 0 | 1.07 | 5.44 |
| 6 | 0 | 0 | 0 | 0 | 0 | 0 | 1.1 | 1 | 0 | 1.07 | 0 | 1.07 | 1 | 0 | 0 | 1.1 | 6.34 |
| 7 | 1.1 | 0 | 1 | 1 | 0 | 1.07 | 0 | 0 | 1.1 | 0 | 0 | 1.1 | 1 | 0 | 0 | 0 | 8.37 |
| 8 | 0 | 1 | 0 | 0 | 0 | 0 | 1.1 | 0 | 0 | 1.1 | 1 | 1 | 0 | 1.07 | 0 | 1.07 | 6.34 |
| DRIVING DUTIES | 13% | 50% | 50% | 25% | 13% | 38% | 63% | 25% | 63% | 50% | 63% | 50% | 63% | 63% | 38% | 75% | 62.16 |

Fig. 23A $$A=\begin{pmatrix} 0 & 1.1 & 0 & 0 & 0 & 1.1 & 1 & 0 & 1.07 & 1 & 1 & 0 & 1.07 & 1 & 1 & 1 \\ 0 & 0 & 1.1 & 0 & 1.07 & 0 & 0 & 0 & 1.1 & 1 & 0 & 1.07 & 0 & 1.07 & 1 & 1 \\ 0 & 1.1 & 0 & 1.07 & 0 & 0 & 1.1 & 1 & 1 & 0 & 1.07 & 0 & 1.07 & 0 & 1.07 & 0 \\ 0 & 1.1 & 1 & 0 & 0 & 1.1 & 1 & 0 & 0 & 0 & 1.1 & 0 & 1.07 & 1 & 0 & 1.07 \\ 0 & 0 & 1.1 & 0 & 0 & 0 & 0 & 0 & 1.1 & 0 & 1.07 & 0 & 0 & 1.1 & 0 & 1.07 \\ 0 & 0 & 0 & 0 & 0 & 0 & 1.1 & 1 & 0 & 1.07 & 0 & 1.07 & 1 & 0 & 0 & 1.1 \\ 0 & 0 & 1 & 1 & 0 & 1.07 & 0 & 0 & 1.1 & 0 & 0 & 1.1 & 1 & 0 & 0 & 0 \\ 0 & 1 & 0 & 0 & 0 & 0 & 1.1 & 0 & 0 & 1.1 & 1 & 1 & 0 & 1.07 & 0 & 1.07 \end{pmatrix}$$

Fig. 23B $$B=\begin{pmatrix} 1.10 & 1.08 & 1.08 & 1.095 & 1.10 & 1.09 & 1.07 & 1.095 & 1.07 & 1.08 & 1.07 & 1.08 & 1.07 & 1.07 & 1.09 & 1.06 \end{pmatrix}$$

Fig. 23C $$A \cdot {}^{t}B = \begin{pmatrix} 11.1 \\ 9.07 \\ 9.16 \\ 9.06 \\ 5.82 \\ 6.82 \\ 9.07 \\ 6.79 \end{pmatrix}$$

PRINTER, METHOD OF MONITORING RESIDUAL QUANTITY OF INK, AND RECORDING MEDIUM

BACKGROUND OF THE INVENTION

1. Field of the Invention

The present invention relates to a technique of causing ink droplets to be ejected on a printing medium, so as to print an image. More specifically the present invention pertains to a technique of accurately monitoring a residual quantity of ink remaining in an ink reservoir that stores the ink therein.

2. Description of the Related Art

Printers that cause ink droplets to be ejected on a printing medium to print an image are widely used as an output device of various images output from a computer or the like. Such a printer uses the ink stored in an ink reservoir to eject ink droplets, and thereby can not print an image after the ink in the ink reservoir is used up.

Some techniques have accordingly been developed to monitor the residual quantity of ink in the ink reservoir. One of such techniques installs a sensor in the ink reservoir to monitor the residual quantity of ink. This technique with the sensor enables the residual quantity of ink to be monitored directly. Another known technique multiplies the number of ink droplets ejected by a weight of a single ink droplet measured in advance, so as to calculate the amount of ink consumption, and estimates the residual quantity of ink in the ink reservoir from the calculated amount of ink consumption. Since the printer ejects ink droplets under the control of the computer, it is easy to count the total number of ink droplets ejected with the control computer. This technique enables the residual quantity of ink in the ink reservoir to be monitored without any specific sensor.

When this known technique is applied to monitor the residual quantity of ink, there may be a significant difference between the actual remaining quantity of ink and the calculated remaining quantity of ink. As is known by those skilled in the art, the size of an ink droplet ejected from a nozzle depends upon the viscosity of the ink. One proposed technique takes into account a change of the viscosity according to the temperature of the ink, in order to improve the accuracy of calculating the residual quantity of ink. This proposed technique can not, however, attain the sufficient accuracy.

SUMMARY OF THE INVENTION

The object of the present invention is thus to precisely estimate an amount of ink consumption and thereby monitor a residual quantity of ink remaining in an ink reservoir with high accuracy.

At least part of the above and the other related objects is attained by a printer having an ink jet head that ejects ink droplets and an ink reservoir that has a predetermined capacity to store ink, wherein the ink jet head ejects ink droplets to create ink dots on a printing medium and thereby print an image on the printing medium. The printer includes: a supply condition detection unit that detects an ink supply condition, where an ink droplet ejected from one nozzle affects a supply of ink to another nozzle due to the structure of the ink jet head; an ink ejecting number counter than counts an ink ejecting number ejected by the ink jet head; and a residual ink quantity monitor that monitors a residual quantity of ink remaining in the ink reservoir by taking into account the ink supply condition detected by the supply condition detection unit, based on the ink ejected number counted by the ink ejected number counter and the predetermined capacity of the ink reservoir.

The present invention also provides a method of monitoring a residual quantity of ink, which corresponds to the printer of the present invention discussed above. Namely the present invention is directed to a method of monitoring a residual quantity of ink remaining in an ink reservoir, wherein the method is applied for a printer having an ink jet head that ejects ink droplets and the ink reservoir that has a predetermined capacity to store ink, and the ink jet head ejects ink droplets to create ink dots on a printing medium and thereby print an image on the printing medium. The method includes the steps of: (a) detecting an ink supply condition, where an ink droplet ejected from one nozzle affects a supply of ink to another nozzle due to the structure of the ink jet head; (b) counting an ink ejecting number ejected by the ink jet head; and (c) monitoring a residual quantity of ink remaining in the ink reservoir by taking into account the ink supply condition detected in the step (a), based on the ink ejected number counted in the step (b) and the predetermined capacity of the ink reservoir.

The printer or the corresponding method of the present invention detects the ink supply condition relating to the supply of ink and counts the number of ink droplets ejected by the ink jet head. The structure takes into account the detected ink supply condition and monitors the residual quantity of ink in the ink reservoir based on the count of the ink ejecting number and the predetermined capacity of the ink reservoir. The amount of ink ejected from the ink jet head depends upon the ink supply condition. This arrangement of the present invention monitors the residual quantity of ink while taking into account the ink supply condition, thereby enabling the residual quantity of ink remaining in the ink reservoir to be monitored with high accuracy.

In the printer and the corresponding method of the present invention, the weight of a single ink droplet measured in a specified state of the ink supply condition may be stored in advance as a unit amount of ink. In the process of printing an image, the procedure first detects the ink supply condition relating to the supply of ink and counts an ink ejecting number within a preset time period. The procedure then multiplies the count of the ink ejecting number by the measured weight of a single ink droplet while taking into account the detected ink supply condition, and determines the ejecting amount of ink within the preset time period. The ink ejecting number may be a number of ink droplets actually ejected by the ink jet head or any suitable variable that is readily counted and is convertible to the number of ink droplets. The procedure subsequently accumulates the ejecting amount of ink thus determined to give a cumulative amount of ink ejection and monitors the residual quantity of ink remaining in the ink reservoir based on the cumulative amount of ink ejection and the predetermined capacity of the ink reservoir. The arrangement of taking into account the ink supply condition enables the precise calculation of the ejecting amount of ink and thereby enables the residual quantity of ink remaining in the ink reservoir to be monitored with high accuracy.

In accordance with one preferable modification, the printer stores the volume of a single ink droplet as the unit amount of ink, instead of the weight of a single ink droplet. In the process of printing an image, the procedure detects the ink supply condition and counts the ink ejecting number within the preset time period. The procedure then calculates the ejecting amount of ink within the preset time period from the stored volume of a single ink droplet and the count of the ink ejecting number while taking into account the detected ink supply condition, and accumulates the ejecting amount of ink thus determined to monitor the residual quantity of ink remaining in the ink reservoir. This structure calculates the ejecting amount of ink while taking into account the ink supply condition. This enables the ejecting amount of ink to be calculated precisely and thereby improves the accuracy of monitoring the residual quantity of ink.

The following technique is preferably applicable to take into account the effect of the ink supply condition in the process of calculating the ejecting amount of ink within the preset time period. The technique stores in advance adequate correction coefficients corresponding to a variety of ink supply conditions. The procedure multiplies the weight of a single ink droplet, the count of the ink ejecting number within the preset time period, and the correction coefficient corresponding to the detected ink supply condition. This arrangement corrects a variation in weight of a single ink droplet according to the change of the ink supply condition and enables the ejecting amount of ink within the preset time period to be calculated with high accuracy.

Another preferable application stores the weight of a single ink droplet ejected in each state of the ink supply condition corresponding to the each state of the ink supply condition, in place of the weight of a single ink droplet ejected in the specified state of the ink supply condition. The ejecting amount of ink within the present time period is calculated by multiplying the count of the ink ejecting number by the weight of a single ink droplet corresponding to the detected state of the ink supply condition. This arrangement also enables the ejecting amount of ink to be calculated with high accuracy by taking into account a possible variation in size of the ink droplet according to the ink supply condition.

In the printer of the present invention, it is preferable that the temperature of the ink supplied to the ink jet head is measured as the ink supply condition. The measurement of the temperature of ink enables the ejecting amount of ink to be calculated by taking into account the fact that an increase in viscosity of ink prevents a smooth supply of ink to the ink jet head. This arrangement accordingly improves the accuracy of monitoring the residual quantity of ink remaining in the ink reservoir.

It is also preferable that the ink supply condition is defined as a change of a condition with time accompanied by the ejection of ink droplets; for example, the residual quantity of ink in the ink reservoir or the cumulative ink ejecting number. The detection of such conditions enables the ejecting amount of ink to be calculated by taking into account the fact that the size of the ink droplet is affected by the residual quantity of ink in the ink reservoir and the increased viscosity of the ink over a long time period. This arrangement accordingly improves the accuracy of monitoring the residual quantity of ink remaining in the ink reservoir.

It is further preferable that a condition depending upon the composition of ink is detected as the ink supply condition. The condition depending upon the composition of ink may be a simple condition, such as the product number of ink representing the type of ink, as well as the types of the solvent and dye in the ink and its mixing ratio. The composition of ink generally depends upon the type of ink. The detection of the condition depending upon the composition of ink enables the ejecting amount of ink to be calculated by taking into account the fact that the ink supply condition, such as the viscosity of ink, is varied with a variation in composition. This arrangement accordingly improves the accuracy of monitoring the residual quantity of ink remaining in the ink reservoir.

In accordance with another preferable application of the present invention, the amount of ink to be supplied to the ink jet head may be determined as the ink supply condition. As described previously, the size of the ink droplet ejected is affected by the supply of ink fed to the ink jet head. The structure of determining the amount of ink to be supplied to the ink jet head and calculating the ejecting amount of ink based on the result of the determination enables the residual quantity of ink in the ink reservoir to be monitored with high accuracy.

In the printer where the ink jet head ejects ink droplets to print an image while changing the relative position to the printing medium, it is preferable that a preset printing resolution is detected as the ink supply condition. The printing resolution here is an index representing a distance between adjoining ink dots created on the printing medium when the ink jet head successively ejects ink droplets while changing the relative position to the printing medium. A typical index representing the printing resolution is dpi, that is, a number of ink dots that can be created per inch. For example, the printing resolution of 720 dpi means that 720 ink dots may be created per inch. In such a printer, the printing resolution may be changed according to the desired printing quality and printing speed. The higher printing resolution may increase the number of ink droplets ejected per unit time. This leads to a shortage of the ink supply and causes smaller ink droplets to be ejected. Because of the relationship between the printing resolution and the size of the ink droplet, the detection of the printing resolution as the ink supply condition readily improves the accuracy of calculation of the ejecting amount of ink and enables the residual quantity of ink in the ink reservoir to be monitored with high accuracy.

In such a printer, it is also preferable that a recording mode is detected as the ink supply condition. The recording mode here represents the number of relative movements of the ink jet head to the printing medium required to complete one raster line. The raster line means a line of ink dots formed when the head ejects ink droplets while changing the relative position to the printing medium. In the case where a high printing quality is required, the printer may form one raster line by a plurality of relative movements of the ink jet head to the printing medium, instead of one relative movement. Printing one raster line by a plurality of scans naturally reduces the number of ink droplets ejected in each scan. Printing one raster line by one scan, on the other hand, increases the number of ink droplets ejected within a short time period. This causes small ink droplets to be ejected. The structure of detecting the recording mode as the ink supply condition thus readily improves the accuracy of calculation of the ejecting amount of ink.

In accordance with still another preferable application of the present invention, a dot pattern, which is an arrangement of ink dots formed on the printing medium, may be detected as the ink supply condition. This arrangement enables the ejecting amount of ink to be calculated by taking into account the fact that the size of the ink droplet ejected is affected by the dot pattern. This accordingly enables the residual quantity of ink in the ink reservoir to be monitored with high accuracy.

It is preferable that a relative driving frequency is detected as the dot pattern. The relative driving frequency here is an index representing the time-based frequency at which each nozzle ejects ink droplets. The concrete definition is given below. It is assumed that a certain nozzle ejects ink droplets to create dots while moving on the printing medium. A certain dot created on the printing medium is specified as a target dot. In the case where a dot has been created immediately before the target dot, that is, when dots are successively created, the relative driving frequency of the target dot is defined as 100%. In the case where no dot has been created immediately before the target dot and an adjoining dot is apart from the target dot by the interval of one dot, the relative driving frequency of the target dot is defined as 50%. In a similar manner, in the case where an adjoining dot is apart from the target dot by the interval of two dots, the relative driving frequency of the target dot is defined as 33%. In the case where an adjoining dot is apart from the target dot by the interval of three dots, the relative driving frequency of the target dot is defined as 25%. The size of the ink droplet ejected from the nozzle is varied with a variation in relative driving frequency of the dot formed by the ink droplet. The detection of the relative driving frequency as the dot pattern thus enables the ejecting amount of ink to be calculated by taking into account this factor and thereby improves the accuracy of monitoring the residual quantity of ink remaining in the ink reservoir.

In the printer having the ink jet head that can simultaneously create a plurality of ink dots, it is preferable that a driving duty is detected as the dot pattern. The driving duty here is an index representing a ratio of the number of ink dots created simultaneously to the number of ink dots that can be created simultaneously by the ink jet head. The concrete definition is given below. It is here assumed that 48 dots can be created simultaneously on the printing medium. When 12 dots are created simultaneously, the driving duty is defined as 25%. When 24 dots are created simultaneously, the driving duty is defined as 50%. The size of the ink droplet ejected from the nozzle is affected by the driving duty. The structure of calculating the ejecting amount of ink by detecting the driving duty and taking into account this factor accordingly enables the residual quantity of ink in the ink reservoir to be monitored with high accuracy.

In such a printer, it is also preferable that the number of ink dots created simultaneously is determined to be greater than a preset value (first recording condition) or not greater than the preset value (second recording condition) as the dot pattern. The size of the ink droplet is also varied according to the difference of the recording condition. The structure of calculating the ejecting amount of ink by taking into account this factor accordingly enables the residual quantity of ink in the ink reservoir to be monitored with high accuracy.

A plurality of ink dots that can be created simultaneously may be divided into a plurality of groups, based on a specific relationship. In this case, it is preferable that the driving duty is detected for each group.

The following describes the division of the plurality of groups based on the specific relationship. By way of example, in the printer having a plurality of ink chambers, some of the adjoining ink chambers may receive supplies of ink via an identical ink supply conduit, because of some manufacturing reasons. One applicable technique for ejecting ink droplets drives an actuator to vibrate a vibrating plate, which defines a top plate of the ink chamber, and thereby causes ink droplets to be ejected. Because of some manufacturing reasons, one long vibrating plate may form a common top plate of the adjoining ink chambers. In such cases, the ink chambers having the common ink supply conduit or the ink chambers having the common vibrating plate are included in the same group.

One available arrangement counts the ink ejecting number within the preset time period with respect to each group and calculates the ejecting amount of ink from the ink ejecting number and the weight of a single ink droplet while taking into account the driving duty of each group. This arrangement improves the accuracy of calculation of the ejecting amount of ink and thereby enables the residual quantity of ink in the ink reservoir to be monitored with high accuracy.

In accordance with one preferable application of the present invention, the mechanism for ejecting ink droplets has an optical sensor that measures the intensity of reflected light from the printing medium. The optical sensor may be used to detect an arrangement of ink dots actually formed on the printing medium. This arrangement enables the ejecting amount of ink to be calculated by taking into account the difference in arrangement of ink dots actually formed on the printing medium, thereby further improving the accuracy of monitoring the residual quantity of ink in the ink reservoir.

The following arrangement may be adopted in the printer having the ink jet head that can eject at least two different types of ink droplets having different sizes. The arrangement stores in advance the weight of each type of ink droplet possibly created. The arrangement counts the ink ejecting number within the preset time period and calculates the ejecting amount of ink with respect to each type of ink droplet. The procedure may sum up the ejecting amounts of ink within the preset time period for the respective types of ink dots and accumulate the total ejecting amount of ink. In the printer that can eject at least two different types of ink droplets having different sizes, this arrangement precisely calculates the ejecting amount of ink and enables the residual quantity of ink in the ink reservoir to be monitored with high accuracy.

Another possible procedure stores the weight of a single ink droplet, for example, only for the smallest ink dot and relative factors to the smallest ink dot for the other ink dots. This procedure counts the ink ejecting number within the preset time period as the ink ejecting number corresponding to the smallest ink dots formed on the printing medium. The ejecting amount of ink may be calculated from the count of the ink ejecting number and the weight of ink for the smallest ink dot. In the printer that can create at least two different types of ink dots having different sizes, this arrangement improves the accuracy of calculation of the ejecting amount of ink and enables the residual quantity of ink in the ink reservoir to be monitored with high accuracy. This procedure favorably simplifies the process of calculation, compared with the above procedure that separately calculates the ejecting amount of ink for each type of ink dot and then sums up the ejecting amounts of ink.

The following arrangement may be adopted to monitor the residual quantity of ink for each color in the printer that has an ink reservoir storing a plurality of inks having various colors and causes ink droplets of the various colors to be ejected to create ink dots of the various colors on the printing medium. The arrangement counts the ink ejecting number within the preset time period for each color, and calculates the ejecting amount of ink for each color from the count of the ink ejecting number for each color and the weight of a single ink droplet. The arrangement accumulates the ejecting amount of ink to give a cumulative amount of ink ejection with respect to each color and monitors the residual quantity of each color ink in the ink reservoir based on the cumulative amount of ink ejection and a predetermined capacity of each color ink. In the printer that can create ink dots of various colors with the various color inks, this arrangement precisely calculates the ejecting amount of ink for each color ink and enables the residual quantity of each color ink in the ink reservoir to be monitored with high accuracy.

In accordance with another preferable application of the present invention, an alarm may be given when the difference between the cumulative amount of ink ejection and the predetermined capacity of the ink reservoir becomes not greater than a predetermined value. The alarm may be an alarm lamp, a buzzer, or a message displayed on the CRT. The operation of 'giving an alarm' includes not only that the printer directly gives an alarm to the user but that the printer gives an alarm to another apparatus, for example, a computer that controls the printer. The degree of alarm may be changed according to the magnitude of the difference. For example, the color of the alarm lamp or the sound of the buzzer may be changed according to the magnitude of the difference. The structure of giving an alarm facilitates the monitor of the residual quantity of ink in the ink reservoir. Here the only requirement for giving an alarm is that the difference between the cumulative amount of ink ejection and the predetermined capacity of the ink reservoir substantially becomes not greater than a predetermined value. By way of example, when the ratio of the cumulative amount of ink ejection to the predetermined capacity of the ink reservoir becomes not less than a preset level, it may be determined that the difference substantially becomes not greater than the predetermined value.

Another available arrangement informs the user of the ratio of the cumulative amount of ink ejection to the predetermined capacity of the ink reservoir in the form of a digital or analogous display. For example, a specific display mounted on the printer or the screen of the computer for controlling the printer may be used to give such information. This arrangement further facilitates the monitor of the residual quantity of ink in the ink reservoir.

Any other suitable method for the printer may be applied to give an alarm or information. One possible method shows how many A4 printing sheets can be printed with the residual quantity of ink. The application of the suitable method for the printer facilitates the monitor of the residual quantity of ink in the ink reservoir.

In the printer that carry out head maintenance operations, which force the ink jet head to eject ink droplets, in order to maintain the ejecting state of ink droplets, the type of the head maintenance operation may be detected as the ink supply condition. There may be a variety of head maintenance operations. For example, the head maintenance operation may be carried out to prevent the ejecting state of ink droplets from being worsened or to recover the worsened ejecting state of ink droplets. The latter includes the operations to recover the slightly worsened ejecting state and the significantly worsened ejecting state. The size of the ink droplet forcibly ejected depends upon the type of the head maintenance operation. Detecting the type of the head maintenance operation accordingly enables the ejecting amount of ink during the head maintenance operation to be calculated with high accuracy, thereby improving the accuracy of monitoring the residual quantity of ink. One modified structure carries out the detection of the ink supply condition and the count of the ink ejecting number during the head maintenance operation and accumulates the ejecting amount of ink. This arrangement also improves the accuracy of monitoring the residual quantity of ink.

The method of monitoring the residual quantity of ink according to the present invention may be attained by combining a printer that ejects ink stored in the ink reservoir with a computer that controls the printer and causing the computer to carry out predetermined processes, such as counting the ink ejecting number. One possible application of the present invention is accordingly a recording medium, in which a program for carrying out the predetermined processes is stored in a computer readable manner. Namely the present invention is directed to a recording medium, in which a program for monitoring a residual quantity of ink remaining in an ink reservoir is recorded in a computer readable manner. The program is applied for a printer having an ink jet head that ejects ink droplets and the ink reservoir that has a predetermined capacity to store ink, wherein the ink jet head ejects ink droplets to create ink dots on a printing medium and thereby print an image on the printing medium. The program causes a computer to carry out the functions of: detecting an ink supply condition, which affects a supply of ink to the ink jet head; counting an ink ejecting number ejected by the ink jet head; and monitoring a residual quantity of ink remaining in the ink reservoir by taking into account the detected ink supply condition, based on the count of the ink ejecting number and the predetermined capacity of the ink reservoir.

The computer reads the program stored in such a recording medium and carries out the required processes including the detection of the ink supply condition, the count of the ink ejecting number, and the monitor of the residual quantity of ink. This arrangement enables the residual quantity of ink remaining in the ink reservoir to be monitored with high accuracy by taking into account a variation in ink supply condition.

One preferable application of the printer according to the present invention corrects the count of the ink ejecting number according to the ink supply condition and monitors the residual quantity of ink remaining in the ink reservoir based on the corrected ink ejecting number and the predetermined capacity of the ink reservoir. The concrete arrangement of this application is discussed below.

The structure of this application measures an ink weight of a unit ink ejecting number under a preset condition (reference condition), divides the predetermined capacity of the ink reservoir by the measured ink weight to calculate a factor, and stores the factor as a preset value corresponding to the predetermined capacity of the ink reservoir. Namely the factor represents the ratio of the ink weight corresponding to the ink ejecting number under the reference condition to the predetermined capacity of the ink reservoir. In the process of printing an image, this structure counts the ink ejecting number while carrying out the correction according to the ink supply condition. The residual quantity of ink remaining in the ink reservoir is monitored using the corrected count of the ink ejecting number and the preset value stored in advance. This arrangement enables the residual quantity of ink to be monitored with high accuracy by taking into account a change of the ink supply condition.

These and other objects, features, aspects, and advantages of the present invention will become more apparent from the following detailed description of the preferred embodiments with the accompanying drawings.

BRIEF DESCRIPTION OF THE DRAWINGS

FIG. 20A shows exemplified settings of the correction coefficient corresponding to the driving frequency in this embodiment;

FIG. 20B shows exemplified settings of the correction coefficient corresponding to the driving duty in this embodiment;

FIG. 22A shows an example of dot data read to determine the dot pattern correction coefficient;

FIG. 22B shows a process of calculating the dot pattern correction coefficient;

FIG. 23A shows a matrix of correction coefficients based on the driving frequency, which is obtained from the dot data of FIG. 22A;

FIG. 23B shows a matrix of correction coefficients based on the driving duty, which is obtained from the dot data of FIG. 22A;

FIG. 23C shows a matrix of correction coefficients based on both the driving frequency and the driving duty;

DESCRIPTION OF THE PREFERRED EMBODIMENTS

A. Structure of System

Figure 1:
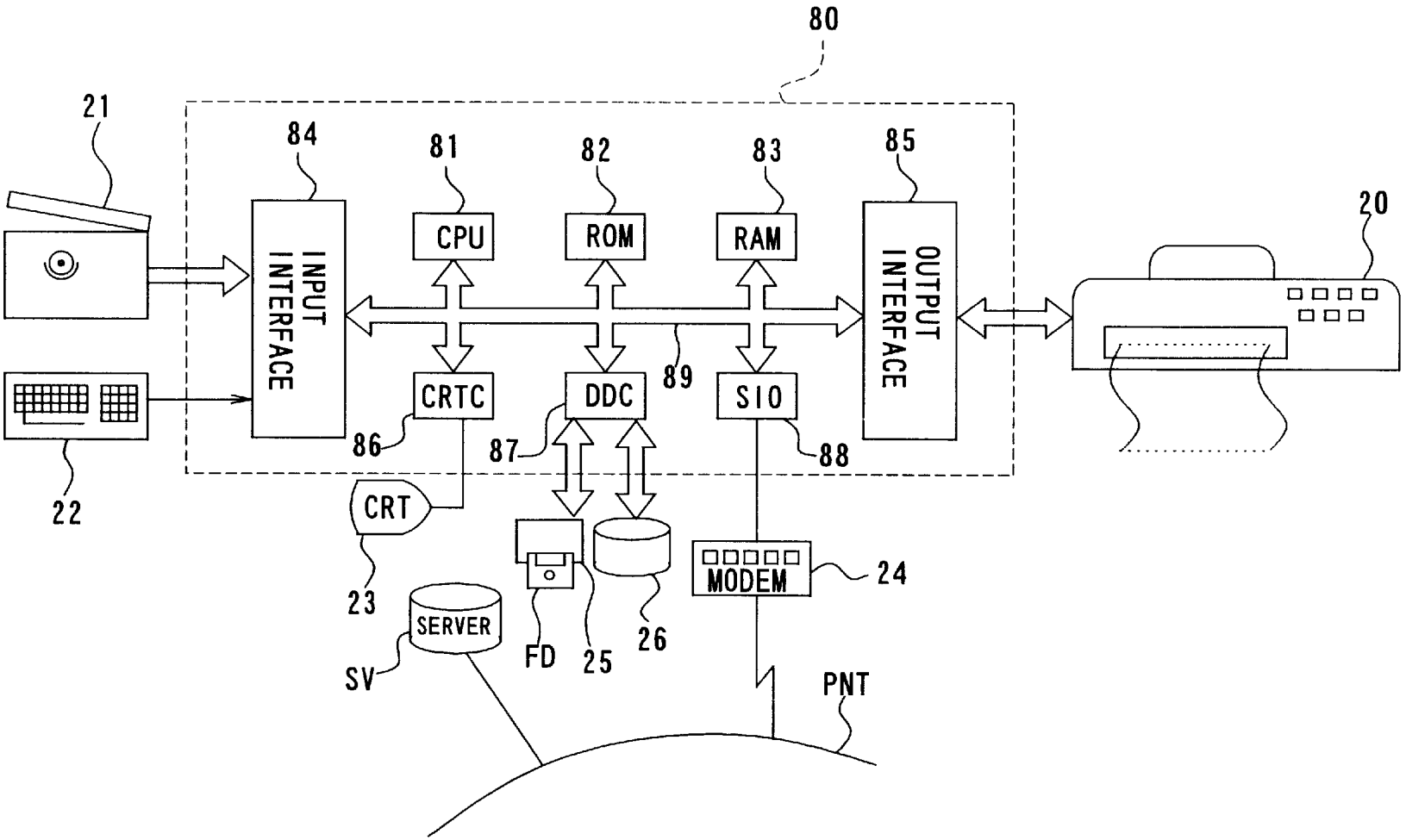
FIG. 1 schematically illustrates the structure of a printing system in a first embodiment according to the present invention.

FIG. 1 schematically illustrates the structure of a printing system in a first embodiment according to the present invention. As illustrated, the printing system includes a color scanner 21 and a color printer 20 connected to a computer 80. The printing system functions as a whole when the computer 80 loads and executes a selected program. A color original to be printed is converted into color image data ORG, which are recognizable by the computer 80, by the color scanner 21 and input into the computer 80. The computer 80 executes preset image processing to convert the input color image data ORG into printer-printable image data and outputs the printer-printable image data to the color printer 20. The image data dealt with by the computer 80 regard images taken in by the color scanner 21 as well as images created on the computer 80 according to a variety of applications programs 91 and images taken in by the color scanner 21 and further processed. The results of conversion of the image data are output as printer-printable image data FNL to the color printer 20. The color printer 20 creates ink dots of the respective colors on a printing sheet according to the image data FNL. This results in creating a color image corresponding to the color image data output from the computer 80 on the printing sheet.

The computer 80 includes a CPU 81 that executes a variety of operations, a ROM 82, a RAM 83, an input interface 84, an output interface 85, a CRT controller (CRTC) 86, a disk controller (DDC) 87, and a serial input/output interface (SIO) 88. These elements are mutually connected via a bus 89 to enable transmission of data. The CRTC 86 controls signal outputs to a color display or CRT 23. The DDC 87 controls transmission of data to and from a flexible disk drive 25, a hard disk 26, and a CD-ROM drive (not shown). A variety of programs loaded to the RAM 83 and executed by the CPU 81 as well as a variety of programs supplied in the form of a device driver are stored in the ROM 82 and the hard disk 26. Connecting the SIO 88 via a modem 24 to a public telephone network PNT enables required data and programs to be downloaded from a server SV on an external network into the hard disk 26.

When a power is supplied to the computer 80, the operating system stored in the ROM 82 and the hard disk 26 is activated and the variety of applications programs 91 work under the control of the operating system.

An ink jet printer that ejects four different color inks, that is, cyan, magenta, yellow, and black, on a printing sheet to print a color image is applied in this embodiment for the color printer 20, although another printer that can print a color image may be used as the color printer 20. The color printer may use six color inks, that is, light cyan and light magenta in addition to the above four color inks. An ink ejecting mechanism of the ink jet printer used in this embodiment utilizes piezoelectric elements PE as discussed later, although the printer may have a head that ejects ink by another available mechanism. One of such available mechanisms supplies electricity to a heater disposed in an ink conduit and utilizes bubbles produced in the ink conduit to eject ink.

The color printer 20 of this embodiment is a variable dot printer that enables three different sizes of dots, that is, large dots, medium dots, and small dots, to be created with respect to each color. The color printer 20 of this embodiment adopts a suitable ink ejecting technique to enable the three different sizes of dots to be created with a single ink eject nozzle. The details of this ink ejecting technique will be discussed later. As clearly understood from the description of the ink ejecting technique, the dots are not restricted to the three different sizes. The technique may be applicable to two different sizes of dots, that is, large dots and small dots, and further to four or more different sizes of dots.

Figure 2:
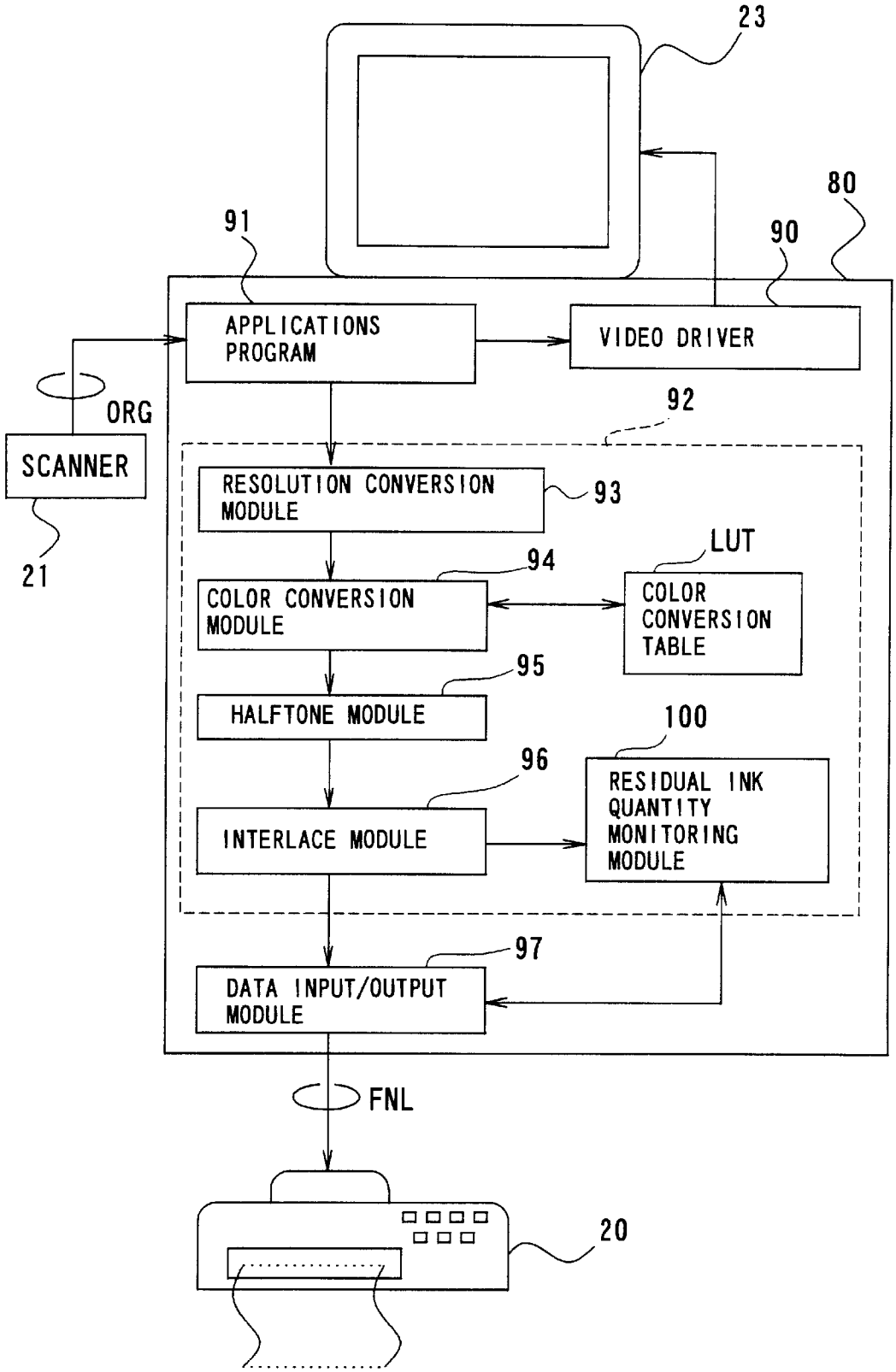
FIG. 2 is a block diagram conceptually illustrating a software configuration of the printing system.

FIG. 2 is a block diagram conceptually illustrating a software configuration of the printing system. In the computer 80, all the applications programs 91 work under an operating system. A video driver 90 and a printer driver 92 are incorporated in the operating system. Image data of the respective applications programs 91 are output from these drivers to the color printer 20 via a data input/output module 97.

When the applications program 91 issues a printing instruction, the printer driver 92 of the computer 80 receives the image data from the applications program 91 and executes preset image processing to convert the input image data into the printer-printable image data. As conceptually shown in FIG. 2, the image processing executed by the printer driver 92 mainly consists of four modules, a resolution conversion module 93, a color conversion module 94, a halftone module 95, and an interlace module 96. The details of the image processing executed by each module will be discussed later. The image data received by the printer driver 92 are converted by these modules and output as the final image data FNL to the color printer 20 via the data input/output module 97.

Figure 3:
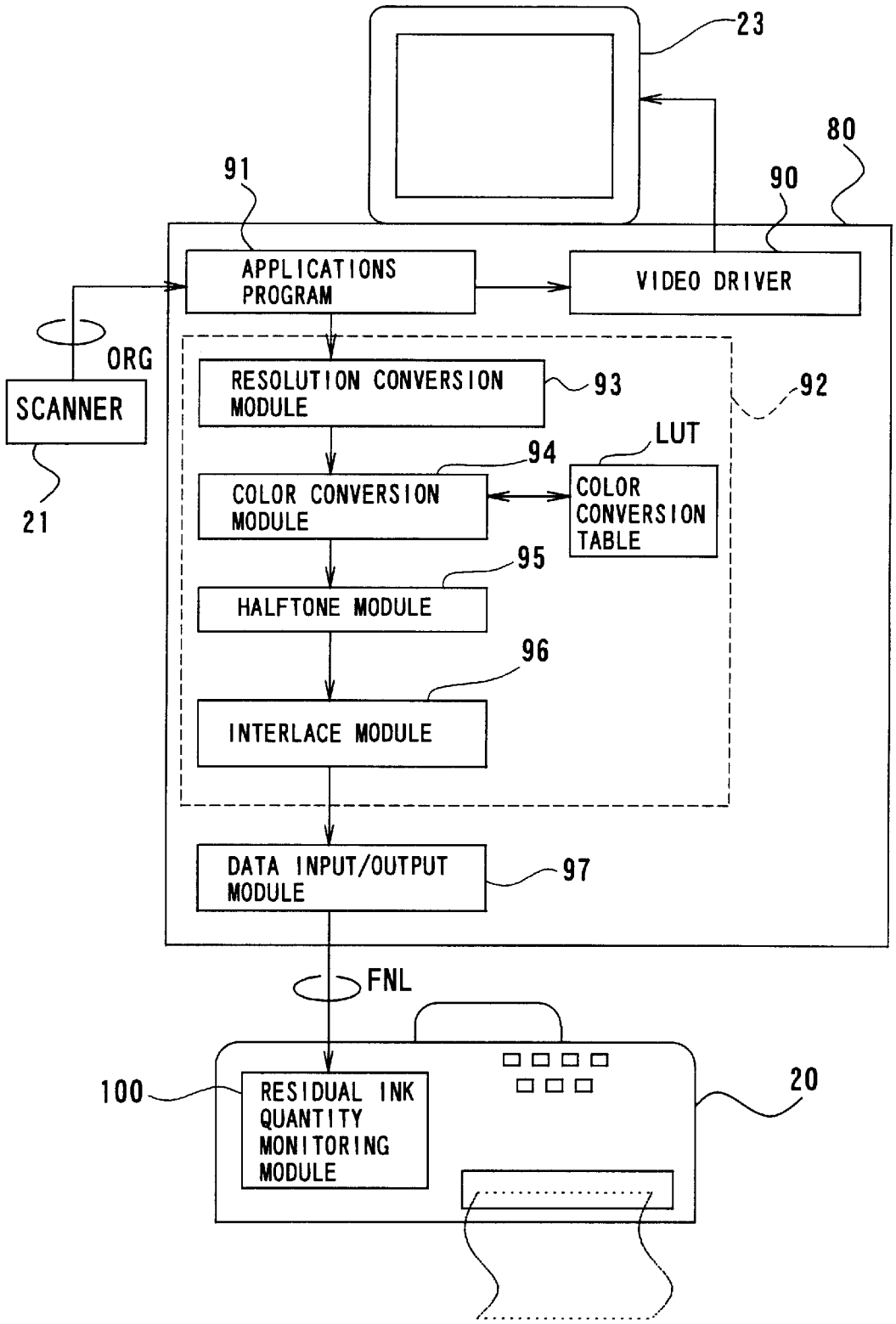
FIG. 3 is a block diagram illustrating another software configuration of the printing system.

The printing system of this embodiment precisely estimates a ejecting amount of ink and thereby monitors the residual quantity of ink with high accuracy. This function is carried out by a residual ink quantity monitoring module, which is typically incorporated in the color printer. The residual ink quantity monitoring module transmits information to and from the interlace module 96 in the computer 80 to monitor the residual quantity of ink. For convenience of explanation, it is thus assumed that a residual ink quantity monitoring module 100 is incorporated in the printer driver 92. The residual ink quantity monitoring module 100 may, however, be incorporated in the color printer 20 as illustrated in FIG. 3. The printer 20 of this embodiment only functions to create dots according to the image data FNL, but part of the other functions, such as the image processing and the monitor of the ink ejecting amount, may be carried out by the color printer 20.

Figure 4:
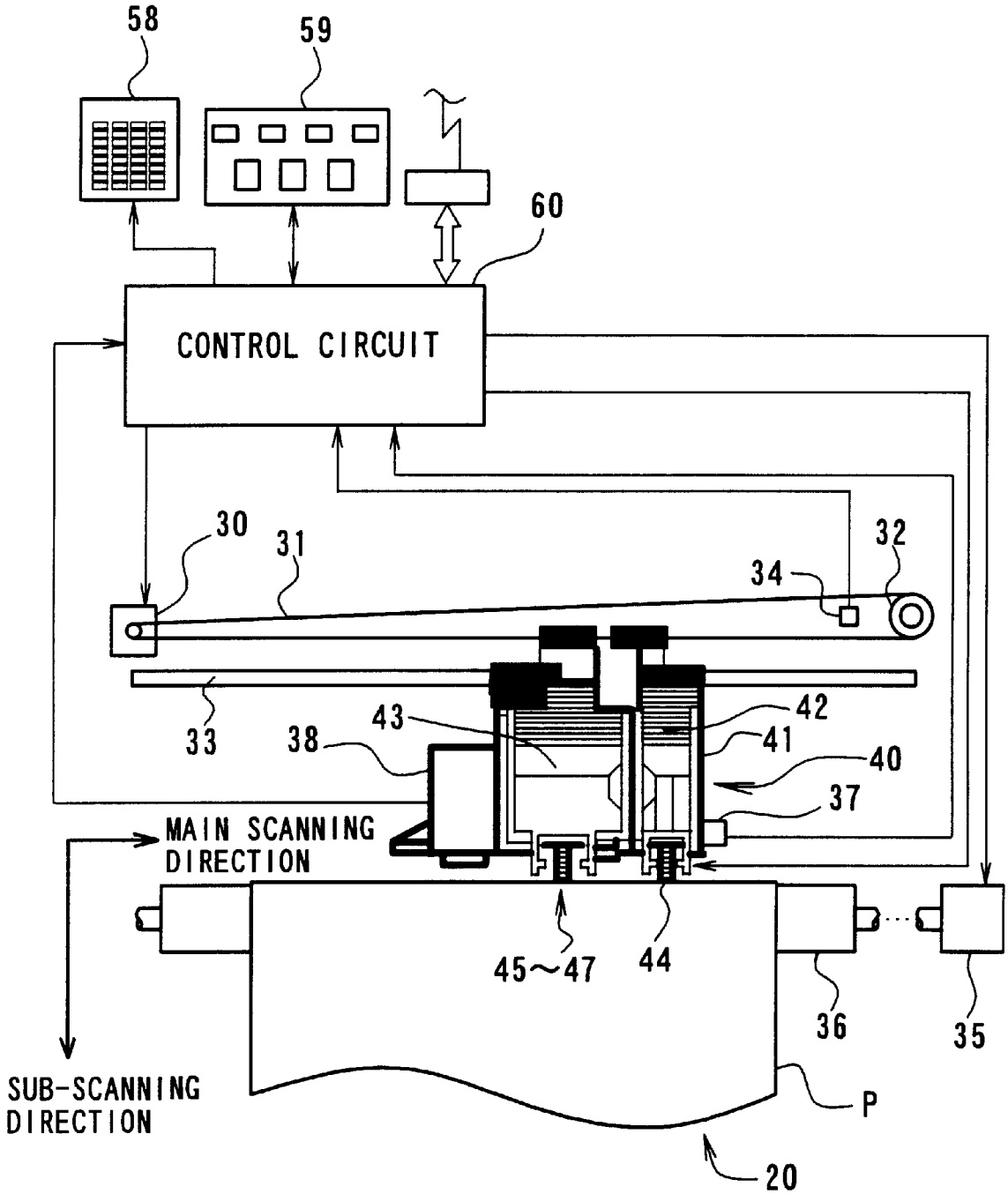
FIG. 4 schematically illustrates the structure of a color printer 20 in this embodiment.

FIG. 4 schematically illustrates the structure of the color printer 20 in this embodiment. As illustrated, the color printer 20 includes a mechanism for driving an ink jet head 41 mounted on a carriage 40 to eject ink and create dots, a mechanism for activating a carriage motor 30 to cause the carriage 40 to reciprocate along an axis of a platen 36, a mechanism for activating a sheet feed motor 35 to feed a printing sheet P, and a control circuit 60. The mechanism of reciprocating the carriage 40 along the axis of the platen 36 includes a sliding shaft 33 that is spanned in parallel with the axis of the platen 36 to support the carriage 40 in a slidable manner, an endless drive belt 31 spanned between the carriage motor 30 and a pulley 32, and a position detector sensor 34 that locates the origin of the carriage 40. The mechanism of feeding the printing sheet P includes the platen 36, the sheet feed motor 35 that rotates the platen 36, a sheet feed auxiliary roller (not shown), and a gear train (not shown) that transmits the rotation of the sheet feed motor 35 to the platen 36 and the sheet feed auxiliary roller. The control circuit 60 adequately controls the operations of the sheet feed motor 35, the carriage motor 30, and the ink jet head 41 and further controls display of a residual ink quantity display panel 58 included in the printer 20, while transmitting signals to and from a control panel 59 of the printer 20. The printing sheet P supplied to the color printer 20 is placed between the platen 36 and the sheet feed auxiliary roller and fed by a preset amount according to the rotational angle of the platen 36.

Figure 5:
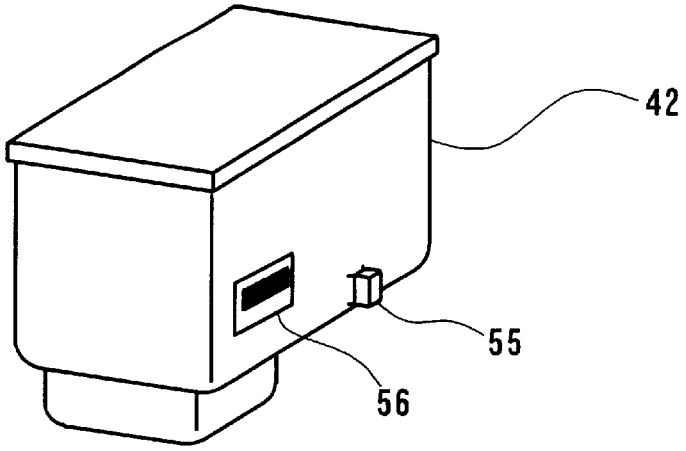
FIG. 5 shows the appearance of an ink cartridge used in the color printer 20 of this embodiment.

A black ink cartridge 42, in which black (K) ink is stored, and a color ink cartridge 43, in which cyan (C), magenta (M), and yellow (Y) inks are stored, contact switches 71 and 72 (see FIG. 10) that detect the attachment and detachment of the ink cartridges 42 and 43 to and from the carriage 40, and a temperature sensor 37 that measures the temperature of the ink jet head 41 are mounted on the carriage 40. As illustrated in FIG. 5, both the ink cartridges 42 and 43 have a projection 55. When either of the ink cartridges 42 and 43 is attached to the carriage 40, the corresponding contact switch of the carriage 40 is pressed by the projection 55 to close the contact. Detachment of the ink cartridge 42 or 43 from the carriage 40, on the other hand, causes the corresponding contact to be open and inform the user of replacement of the ink cartridge. The ink cartridges 42 and 43 have an identification label 56 as shown in FIG. 5. Various pieces of information, such as the product type, the production number, and the ink capacity of the ink cartridge, are indicated by a barcode on the identification label 56.

The ink jet head 41 mounted on the carriage 40 has ink jet heads 44, 45, 46, and 47 corresponding to the respective inks K, C, M, and Y. Supply conduits (not shown) for the respective inks are formed upright in the bottom portion of the carriage 40. When the ink cartridges 42 and 43 are attached to the carriage 40, inks stored in the ink cartridges 42 and 43 are supplied to the ink jet heads 44 through 47 via the supply conduits. The ink supplied to each ink jet head is jetted from the ink jet head 41 according to the method discussed below and creates dots on the printing sheet.

Figure 6A:
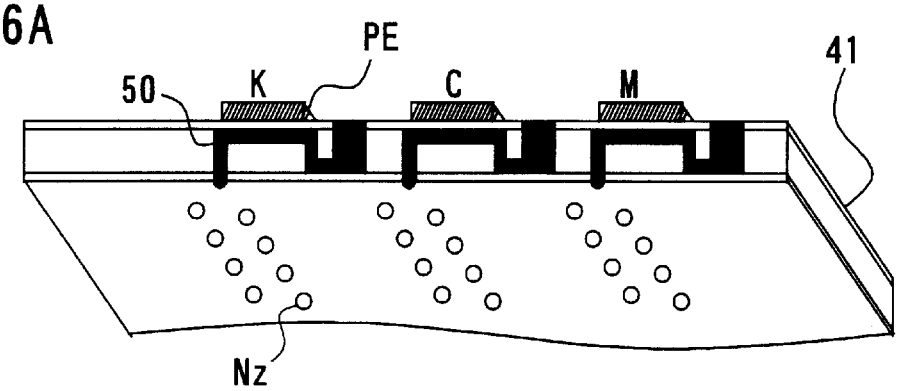
FIG. 6A shows the sectional structure of nozzles in the color printer 20 of this embodiment.

FIG. 6A shows the internal structure of the ink jet head 41. Forty eight nozzles Nz are formed in each of the ink jet heads 44 through 47 corresponding to each color. Each nozzle has an ink conduit 50 and a piezoelectric element PE arranged on the ink conduit 50. As is known by those skilled in the art, the piezoelectric element PE deforms its crystal structure by application of a voltage and implements an extremely high-speed conversion of electrical energy into mechanical energy. In this embodiment, when a preset voltage is applied between electrodes on either end of the piezoelectric elements PE for a predetermined time period, the piezoelectric element PE is expanded for the predetermined time period to deform one side wall of the ink conduit 50. The volume of the ink conduit 50 is accordingly reduced according to the expansion of the piezoelectric element PE. A certain amount of ink corresponding to the reduction is jetted as an ink particle Ip from the nozzle Nz at a high speed. The ink particle Ip soaks into the printing sheet P set on the platen 36 and creates a dot on the printing sheet P.

Figure 7:
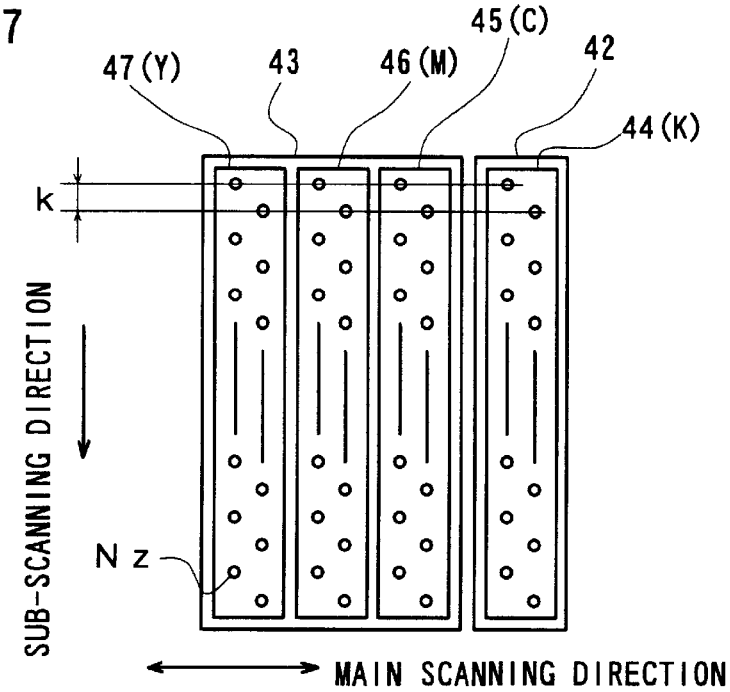
FIG. 7 shows an arrangement of nozzles in the color printer 20 of this embodiment.

FIG. 7 shows an arrangement of ink jet nozzles Nz on the ink jet heads 44 through 47. Four sets of nozzle arrays, from which the respective color inks are ejected, are formed in the bottom faces of the respective ink jet heads 44 through 47. Each set of nozzle array includes forty eight nozzles Nz arranged in zigzag at a preset nozzle pitch k. The forty eight nozzles Nz included in each nozzle array may be arranged in alignment, instead of in zigzag. The zigzag arrangement shown in FIG. 7, however, has an advantage that the nozzle array can be designed to have a small nozzle pitch k.

Referring to FIG. 7, the ink jet heads 44 through 47 of the respective color are shifted in position in the moving direction of the carriage 40. Since the nozzles included in each ink jet head are arranged in zigzag, the nozzles are also shifted in position in the moving direction of the carriage 40. The control circuit 60 of the color printer 20 drives the respective ink jet heads 44 through 47 at suitable head drive timings by taking into account a positional difference of the nozzles in the course of moving the carriage 40 and driving the nozzles.

Figure 6B:
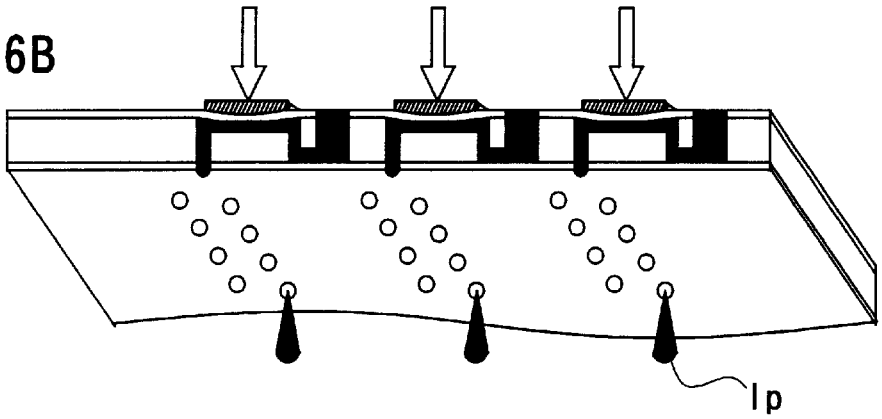
FIG. 6B shows the principle of creating dots in the color printer 20 of this embodiment.
Figure 8A:
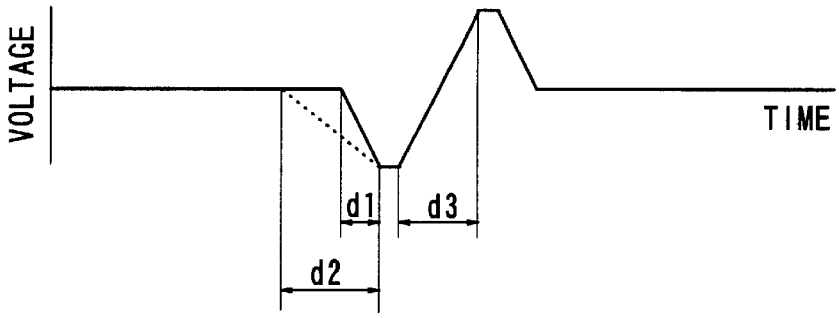
FIG. 8A shows driving waveforms used to create dots of different sizes.
Figure 8B:
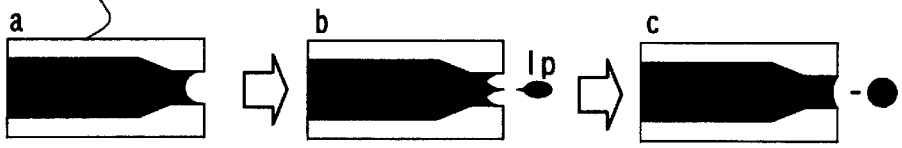
FIG. 8B shows a process of ejecting a small dot.
Figure 8C:
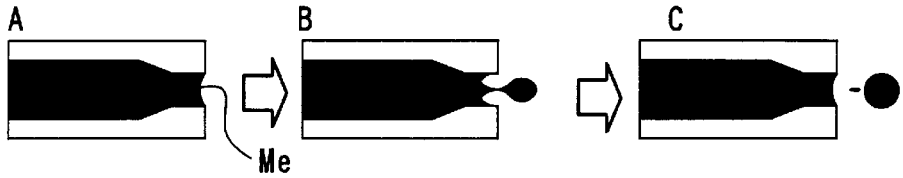
FIG. 8C shows a process of ejecting a large dot.

The color printer 20 of this embodiment has the nozzles Nz of a fixed diameter as shown in FIG. 7. Three different types of dots having different sizes can be formed with the nozzles Nz of the fixed diameter. The following describes the principle of such dot creation technique. FIGS. 8A through 8C show the relationship between the driving waveform of the nozzle Nz and the size of the ink particle Ip ejected from the nozzle Nz. The driving waveform shown by the broken line in FIG. 8A is used to create standard-sized dots. Application of a voltage lower than a reference voltage to the piezoelectric element PE in a division d2 deforms the piezoelectric element PE in the direction of increasing the cross section of the ink conduit 50, contrary to the case discussed previously with the drawing of FIG. 6. Since there is a limit in ink supply speed to the nozzle, the quantity of ink supply is insufficient with respect to the expansion of the ink conduit 50. As shown in a state A of FIG. 8C, an ink interface Me is thus slightly concaved inward the nozzle Nz. When the driving waveform shown by the solid line in FIG. 8A is used to abruptly lower the voltage in a division d1, on the other hand, the quantity of ink supply has further insufficiency and the ink interface Me is more significantly concaved inward the nozzle Nz as shown in a state 'a' shown in FIG. 8B, compared with the state A.

Subsequent application of a high voltage to the piezoelectric element PE in a division d3 shown in FIG. 8A reduces the sectional area of the ink conduit 50 and compresses the ink in the ink conduit 50, thereby causing an ink droplet to be ejected from the ink nozzle. The size of the ink droplet depends upon the degree of insufficiency of the ink supply quantity. As shown in states B and C of FIG. 8C, a large ink droplet is ejected when the ink interface Me is only slightly concaved inward (state A). As shown in states 'b' and 'c' of FIG. 8B, on the other hand, a small ink droplet is ejected when the ink interface Me is significantly concaved inward (state 'a'). The size of the dot to be created can thus be varied by changing the rate of change in the process of lowering the driving voltage (see the divisions d1 and d2).

Figure 9:
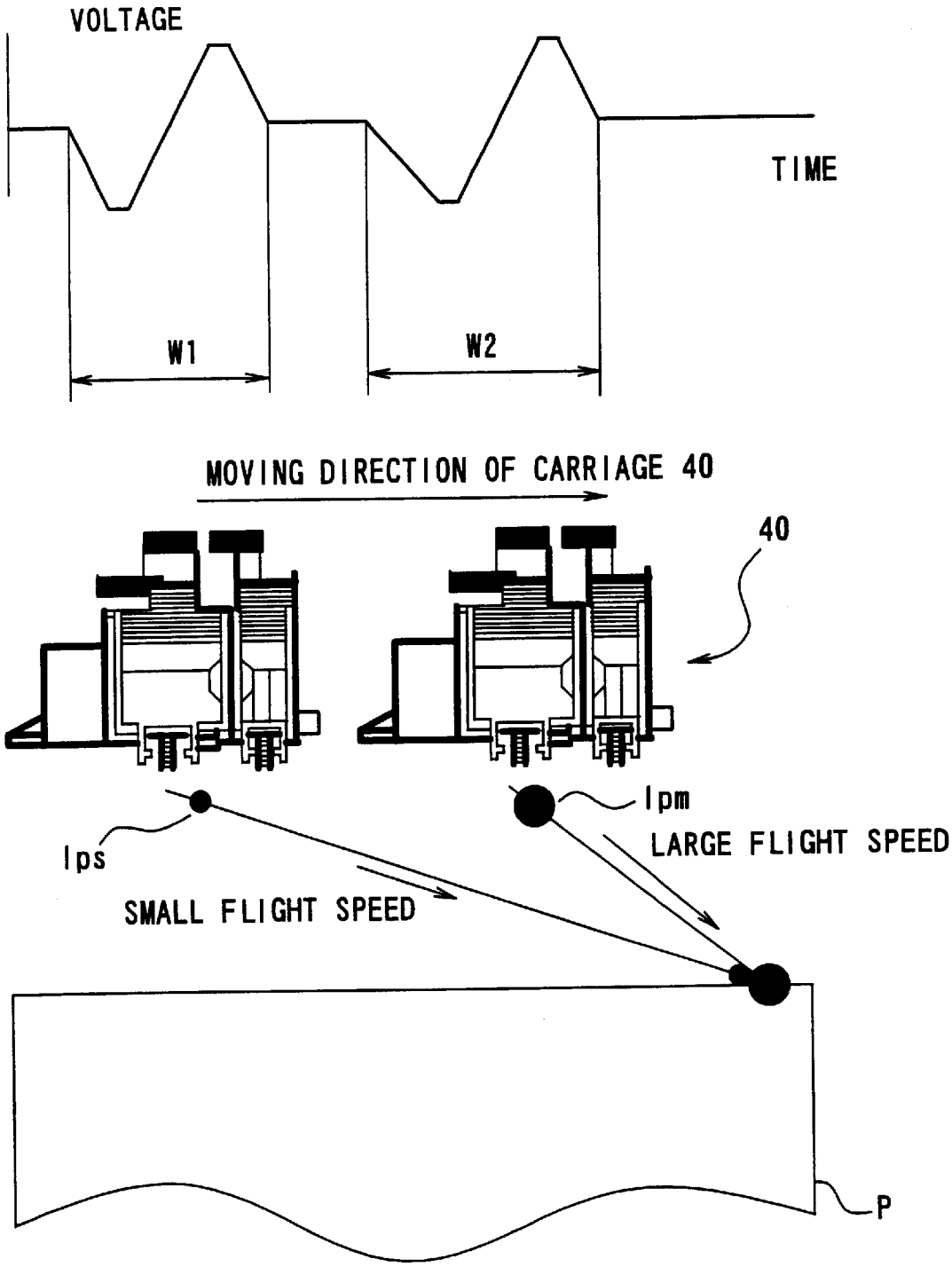
FIG. 9 shows driving waveforms of the nozzle in the color printer 20 of this embodiment and dots created in response to the driving waveforms.

The color printer 20 successively outputs two different driving waveforms W1 and W2 as shown in FIG. 9. According to the difference in rate of change in the process of lowering the driving voltage, the driving waveforms W1 and W2 respectively correspond to a smaller ink droplet Ips and a larger ink droplet Ipm. By way of example, it is assumed that the color printer 20 outputs the driving waveform W1 and the driving waveform W2 in this sequence while moving the carriage 40 in a main scanning direction. The smaller ink droplet Ips ejected in response to the driving waveform W1 has a relatively small flight speed, whereas the larger ink droplet Ipm ejected in response to the driving waveform W2 has a relatively large flight speed. The smaller ink droplet Ips accordingly requires a longer time to hit the printing sheet. Namely, compared with the larger ink droplet Ipm, the smaller ink droplet Ips has a greater moving distance in the main scanning direction from the position where the ink droplet is ejected from the nozzle to the position where the ink droplet hits the printing sheet. Regulating the timings of the driving waveforms W1 and W2 enables the smaller ink droplet Ips and the larger ink droplet to be ejected on an identical pixel as shown in FIG. 9.

The color printer 20 of this embodiment supplies only the driving waveform W1 to the piezoelectric element PE to create small dots, supplies only the driving waveform W2 to the piezoelectric element PE to create medium dots, and supplies both the driving waveforms W1 and W2 to cause two different sizes of ink droplets, that is, the smaller ink droplet and the larger ink droplet, to be ejected on an identical pixel and thereby create large dots. Increasing the types of the driving waveforms enables more dots of different sizes to be created.

Figure 10:
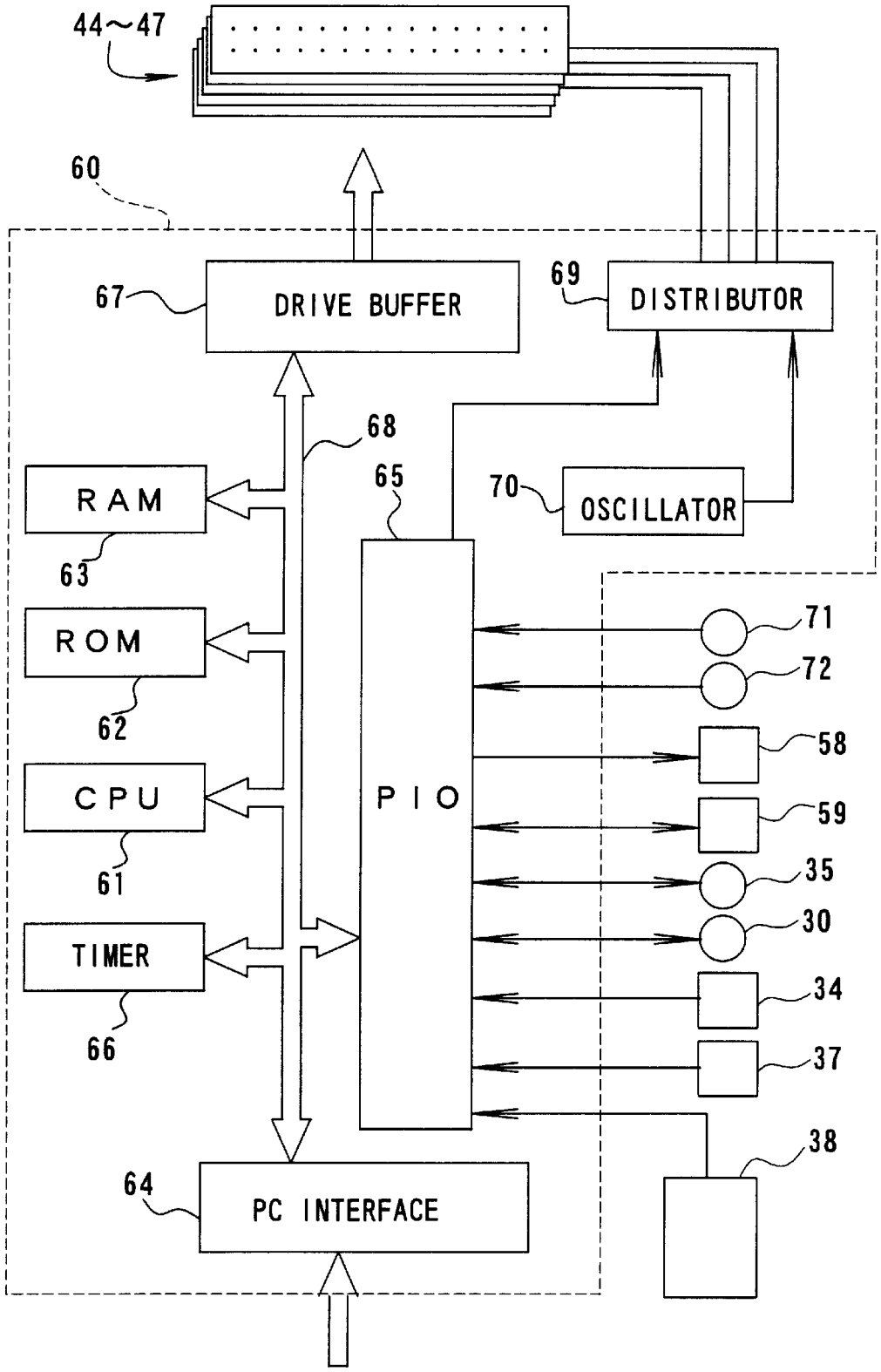
FIG. 10 illustrates the internal structure of a control circuit 60 in the color printer 20 of this embodiment.

FIG. 10 illustrates the internal structure of the control circuit 60 in the color printer 20. The control circuit 60 includes a CPU 61, a ROM 62, a RAM 63, a PC interface 64 that transmits data to and from the computer 80, a peripheral equipment input-output unit (PIO) 65 that transmits data to and from peripheral equipment, a timer 66, and a drive buffer 67. The sheet feed motor 35, the carriage motor 30, the residual ink quantity display panel 58, and the contact switches 71 and 72 transmit data to and from the control circuit 60 via the PIO 65. The drive buffer 67 functions to supply dot on/off signals to the ink jet heads 44 through 47. These elements are mutually connected via a bus 68 to enable transmission of data. The control circuit 60 further includes an oscillator 70 that outputs driving waveforms at selected frequencies and a distributor 69 that distributes the outputs from the oscillator 70 to the ink jet heads 44 through 47 at selected timings.

The control circuit 60 constructed as shown in FIG. 10 receives the image data FNL output from the computer 80 and temporarily stores the dot on/off signals in the RAM 63. The CPU 61 outputs dot data to the drive buffer 67 at a preset timing synchronously with the operations of the sheet feed motor 35 and the carriage motor 30.

Figure 11:
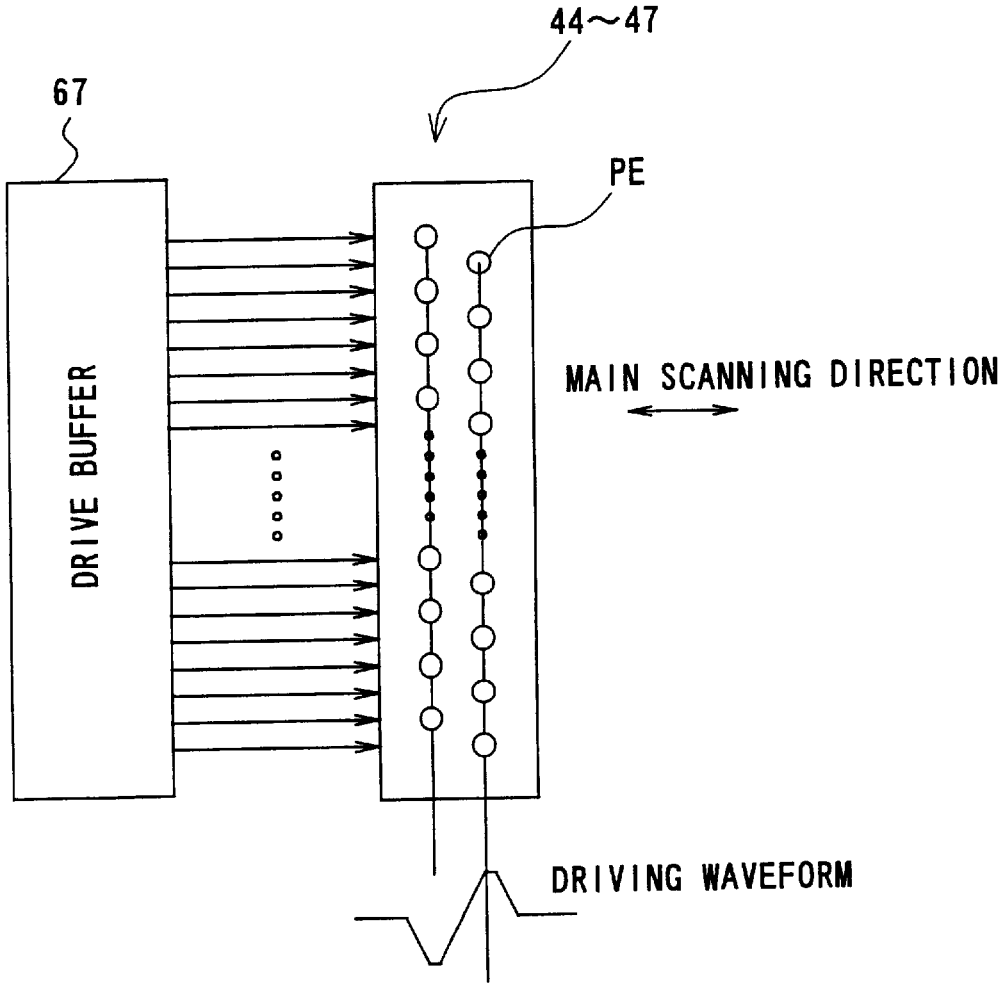
FIG. 11 shows a process in which each of ink jet heads 44 through 47 receives data from a drive buffer 67 and creates dots in this embodiment.

The following describes a mechanism of creating dots in response to the dot on/off signals output from the CPU 61 to the drive buffer 67. FIG. 11 illustrates connection of one nozzle array in the ink jet heads 44 through 47. The nozzle array in each of the ink jet heads 44 through 47 is arranged in a circuit, in which the drive buffer works as the source and the distributor 69 as the sink. The piezoelectric elements PE corresponding to the nozzles included in the nozzle array have one electrodes respectively connected to each output terminal of the drive buffer 67 and the other electrodes collectively connected to the output terminal of the distributor 69. The driving waveforms of the oscillator 70 are output from the distributor 69 as shown in FIG. 11. When the CPU 61 outputs the dot on/off signals of the respective nozzles to the drive buffer 67, only the piezoelectric elements PE receiving the ON signal are driven in response to the output driving waveforms. The ink particles Ip are thus ejected from the nozzles corresponding to the piezoelectric elements PE that have received the ON signal from the drive buffer 67.

The color printer 20 having the hardware configuration discussed above drives the carriage motor 30 to move the ink jet heads 44 through 47 of the respective colors relative to the printing sheet P in the main scanning direction, and drives the sheet feed motor 35 to move the printing sheet P in the sub-scanning direction. Under the control of the control circuit 60, the ink jet head 41 is driven at adequate timings while the main scans and sub-scans of the carriage 40 are repeated. The color printer 20 accordingly prints a color image on the printing sheet P.

B. Outline of Image Processing

Figure 12:
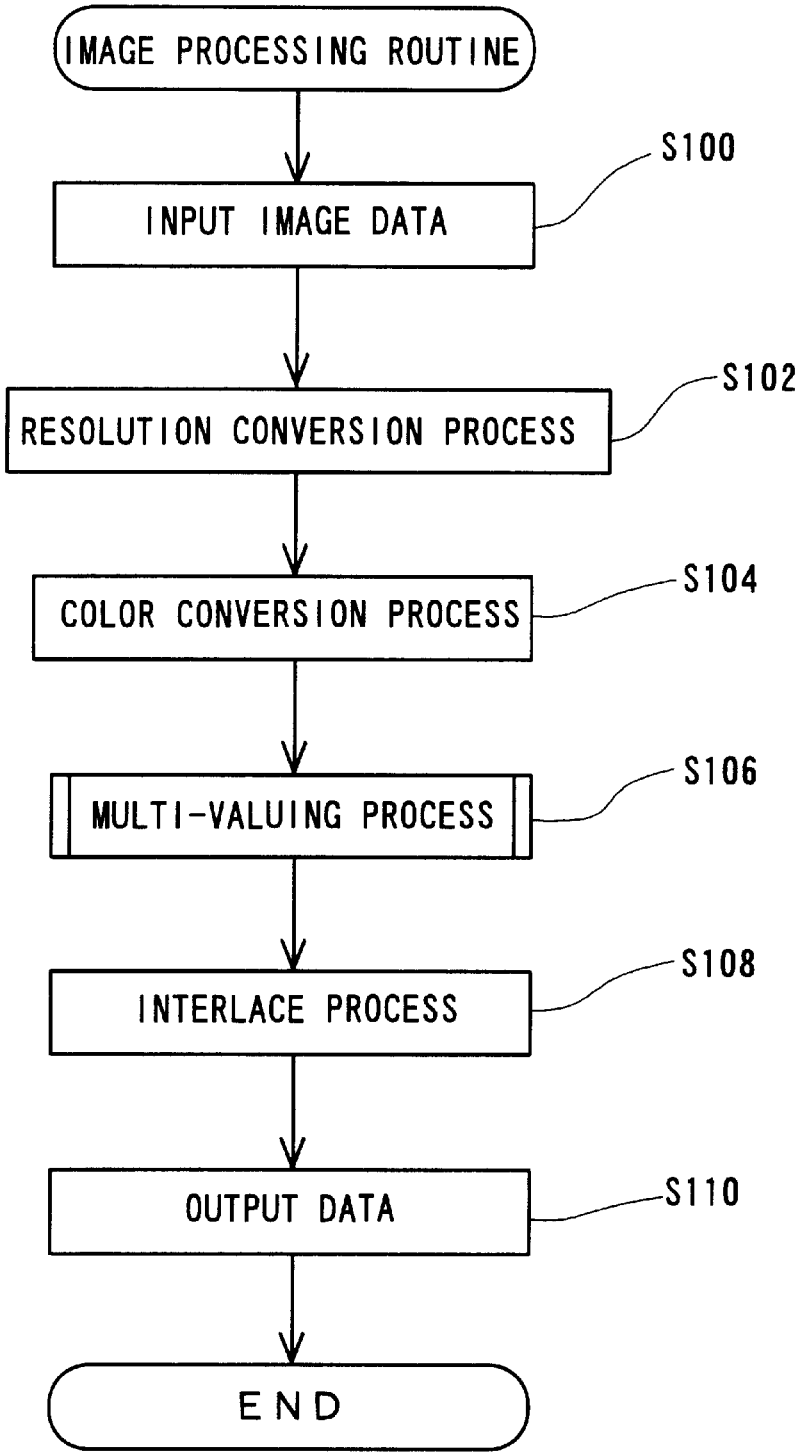
FIG. 12 is a flowchart showing an image processing routine executed in this embodiment.

As discussed above, the color printer 20 has the function of receiving the image data FNL and printing a color image corresponding to the image data FNL. The computer 80 causes a color image to be subjected to predetermined image processing and thereby generates the image data FNL. FIG. 12 is a flowchart showing the outline of an image processing routine executed by the CPU 81 in the printer driver 92 of the computer 80. The outline of the image processing is described with the flowchart of FIG. 12.

When the program enters the image processing routine of FIG. 12, the CPU 81 first input image data at step S100. The image data, which are fed from the applications program 91 as described in FIG. 2, are 256-tone data that may take a value in the range of 0 to 255 for each of the colors R, G, and B corresponding to each pixel included in the image. The resolution of the image data depends upon the resolution of the original image data ORG and the like.

The CPU 81 converts the resolution of the input image data into a printing resolution of the color printer 20 at step S102. In the case where the resolution of the input image data is lower than the printing resolution, linear interpolation is carried out to generate a new piece of data between the adjoining pieces of the original image data ORG and implement the conversion of the resolution. In the case where the resolution of the input image data is higher than the printing resolution, on the contrary, the conversion of the resolution is implemented by skipping some pieces of data at a predetermined rate.

The CPU 81 subsequently carries out color conversion at step S104. The color conversion converts the image data consisting of the tone values of R, G, and B into data in the color printer 20, for example, data consisting of the tone values of C, M, Y, and K. A color conversion table LUT (see FIG. 2) is used for the color conversion. The color conversion table LUT stores combinations of C, M, Y, and K that cause the color printer 20 to express the colors defined by the respective combinations of R, G, and B. A variety of known techniques may be adopted in the color conversion process with the color conversion table. For example, the interpolation technique may be adopted in the color conversion process.

After conclusion of the color conversion, the CPU 81 starts a multi-valuing process at step S106. In this embodiment, the result of the color conversion gives the 256-tone image data consisting of the four colors C, M, Y, and K. In the color printer 20 of this embodiment, on the other hand, there are only four possible states, that is, 'create no dots' 'create a small dot', 'create a medium dot', and 'create a large dot'. It is accordingly required to convert the image of 256 tones into the image of 4 tones expressible by the color printer 20. Namely the probability of creating the respective dots, the large dot, the medium dot, and the small dot, on the printing medium is varied according to the tone values of the original image, so that the 256 tones of the original image are converted into the 4 tone values expressible by the color printer 20. This process is referred to as the tone number conversion process. Especially when the number of tones after the conversion is two, the process is referred to as the binary process. The conversion into a greater number of tones is referred to as the multi-valuing process.

After the multi-valuing process, the CPU 81 starts an interlace process at step S108. The interlace process rearranges the image data converted by the multi-valuing process to specify the creation and non-creation of the respective dots in a sequence to be transferred to the color printer 20. As mentioned previously, the color printer 20 drives the ink jet head 41 and creates dot lines or raster lines on the printing sheet P while repeating the main scans and sub-scans of the carriage 40. As described in FIG. 6, each of the ink jet heads 44 through 47 has the plurality of nozzles Nz, so that one main scan forms a plurality of raster lines. These raster lines are located at the intervals of the nozzle pitch k. In order to create raster lines arranged at the intervals of the pixel, the required control procedure first creates a plurality of raster lines located at the intervals of the nozzle pitch k and slightly moves the head position to create new raster lines between the existing raster lines.

The possible control procedure to improve the printing quality forms each raster line by a plurality of main scans. In order to shorten the printing time, the available control procedure creates dots both in the forward motion and the backward motion of the main scans. The sequence of actual dot creation by the color printer 20 is accordingly different from the sequence of pixels on the image data. The interlace process accordingly rearranges the image data.

After the conclusion of the interlace process, the image data are output as the printer-printable image data FNL to the color printer 20 at step S110.

C. Method of Monitoring Residual Quantity of Ink

The color printer 20 ejects ink droplets according to the image data FNL output from the computer 80 and thereby prints a desired image on the printing medium. The inks stored in the ink cartridges 42 and 43 are used to form the ink droplets. If the ink stored in the ink cartridge is used up, further printing becomes impossible. Replacement of the ink cartridge is thus required to feed a new supply of ink. The early replacement of the ink cartridge prevents the discontinuance of printing due to the run-out in ink in the course of printing an image, but wastes the remaining ink in the ink cartridge. The printing system of this embodiment can monitor the residual quantity of ink with high accuracy and thereby effectively prevents the run-out in ink in the course of printing an image while minimizing the waste of ink remaining in the ink cartridge.

The printing system of this embodiment can monitor the residual quantity of ink with high accuracy, since the ejecting amount of ink is estimated by taking into account the phenomenon found by the inventors of this application, that is, the phenomenon that the weight of an ink droplet or the volume of an ink droplet is varied according to the conditions relating to the supply of ink among a variety of conditions relating to the ejection of ink droplets Prior to the method of monitoring the residual quantity of ink adopted in the printing system of this embodiment, the following briefly describes the phenomenon found by the inventors of this application, that is, the phenomenon that the weight of ink droplet or the volume of an ink droplet is varied according to the conditions relating to the supply of ink.

Figure 27A:
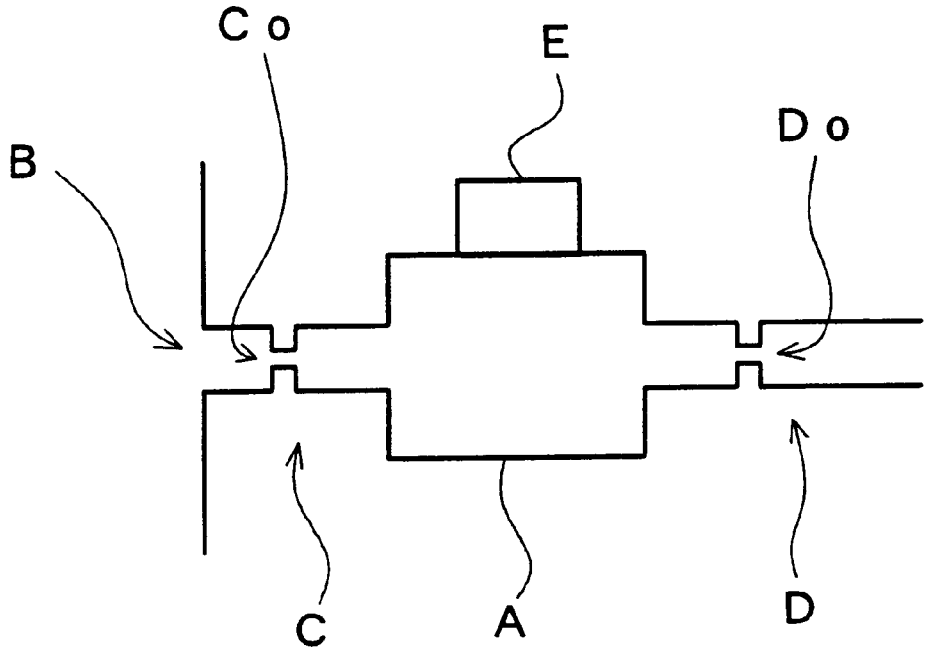
FIG. 27A conceptually illustrates a typical structure of an ink ejecting mechanism.

FIG. 27A conceptually illustrates a typical mechanism of ejecting an ink droplet in the printing system that creates ink dots on a printing medium and thereby prints an image. As illustrated, the fundamental structure of the ink droplet ejecting mechanism includes an ink chamber A, in which a supply of ink fed from an ink reservoir is stored temporarily, a nozzle B, from which an ink droplet is ejected, an ink conduit C that connects the ink chamber A with the nozzle B, an ink supply conduit D that supplies ink in the ink reservoir to the ink chamber A, and an actuator E that enhances the pressure in the ink chamber A. Any means that enhances the pressure of the ink chamber A may be used in place of the actuator E. One available means heats ink with a heater to produce bubbles in the ink and thereby enhance the pressure in the ink chamber. In the example of FIG. 27A, the resistances in the ink conduit C and the ink supply conduit D are schematically expressed by orifices Co and Do.

In the ink droplet ejecting mechanism shown in FIG. 27A, driving the actuator E to enhance the pressure in the ink chamber A and cause a pressure difference before and after the orifice Co causes ink to pass through the orifice Co and to be ejected as an ink droplet from the nozzle B. After the ink droplet is ejected from the nozzle B, a new supply of ink corresponding to the ejecting amount of ink is fed to fill up the ink chamber A and prepare for next ejection of an ink droplet. When the ink supplied has a low temperature, the large viscosity of ink prevents a smooth flow of ink through the ink supply conduit D and may cause an insufficient supply of ink to the ink chamber A. Jetting ink in the state where the ink chamber A is not filled with ink causes a small ink droplet to be ejected from the nozzle B.

The factor that affects the viscosity of ink supplied to the ink chamber A is not restricted to the temperature of ink supplied. For example, different types of inks have different ink compositions and thereby different viscosities. Over a long time period, the volatile components in the ink gradually evaporate to increase the viscosity of ink.

The size of the ink droplet may be varied with a variation in residual quantity of ink remaining in the ink reservoir as discussed briefly below.

Figure 27B:
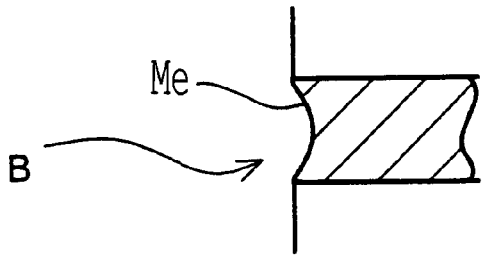
FIG. 27B shows an interface of ink or a meniscus in a nozzle in the typical ink ejecting mechanism.

The nozzle B is set to make the interface Me of ink slightly concaved inward as shown in FIG. 27B in the non-ejecting state of ink. This prevents ink from leaking from the nozzle unnecessarily. A variety of methods may be applied to make the interface Me of ink inward the nozzle B. One typical method places urethane foam inside the ink reservoir. The urethane foam has numerous pores. Ink soaks into these pores and is kept in the urethane foam by means of the surface tension working among the pores, ink, and the air. The nozzle is designed to cause the surface tension acting on ink to be slightly greater than the surface tension occurring on the interface Me of the nozzle by regulating the related parameters, such as the size and the density of the pores. When the ink droplets are not ejected, the interface Me of ink can be kept in the state slightly concaved inward the nozzle.

In the ink reservoir designed as discussed above, the less residual quantity of ink increases the contact area of ink with the air and enhances the surface tension of ink against the urethane foam, thereby causing the interface Me of ink to be concaved significantly inward the nozzle B. Only a small ink droplet is ejected in the state that the interface Me of ink is significantly concaved inward the nozzle B. The size of the ink droplet may thus be varied with a variation in residual quantity of ink in the ink reservoir.

The size of the ink droplet may also be varied according to the difference of a dot pattern, which is an arrangement of ink dots formed on the printing medium. There are a variety of reasons for this phenomenon. By way of example, in order to increase the density of ink dots on the printing medium, it is required to increase the number of ejecting ink droplets per unit time, that is, the ejecting frequency of ink droplets, under the condition of a fixed time period for dot creation. The excessively high ejecting frequency of ink droplets, however, causes an insufficient supply of ink to the ink chamber A through the ink supply conduit D (see FIG. 27A) and thereby reduces the size of the ink droplet ejected from the nozzle.

In the printer having a large number of ink chambers in alignment, when ink droplets are ejected from a selected ink chamber, a supply of ink fed to an adjoining ink chamber becomes insufficient. This may cause a phenomenon called cross talk, in which the ink droplets ejected from the adjoining ink chambers have different sizes.

As discussed above, the weight of the ink droplet ejected is affected in a variety of ways by the ink supply conditions in the process of ejecting ink droplets. The method of monitoring the residual quantity of ink adopted in the printer of this embodiment takes into account the relationship between the weight of the ink droplet ejected and the ink supply conditions and estimates the ejecting weight of ink with high accuracy. This enables the residual quantity of ink in the ink reservoir to be monitored precisely. The following describes the details of the method of monitoring the residual quantity of ink adopted in the printer of this embodiment.

(1) Software Configuration

As discussed previously in FIG. 2, the residual ink quantity monitoring module 100 transmits information to and from the interlace module 96 and monitors the residual quantity of ink. For the clarity of explanation, in the printer of this embodiment, it is assumed that the residual ink quantity monitoring module 100 is incorporated in the printer driver 92. In accordance with a possible modification, the residual ink quantity monitoring module 100 may be incorporated in the color printer 20 and monitor the residual quantity of ink while transmitting information to and from the printer driver 92 in the computer 80.

Figure 13:
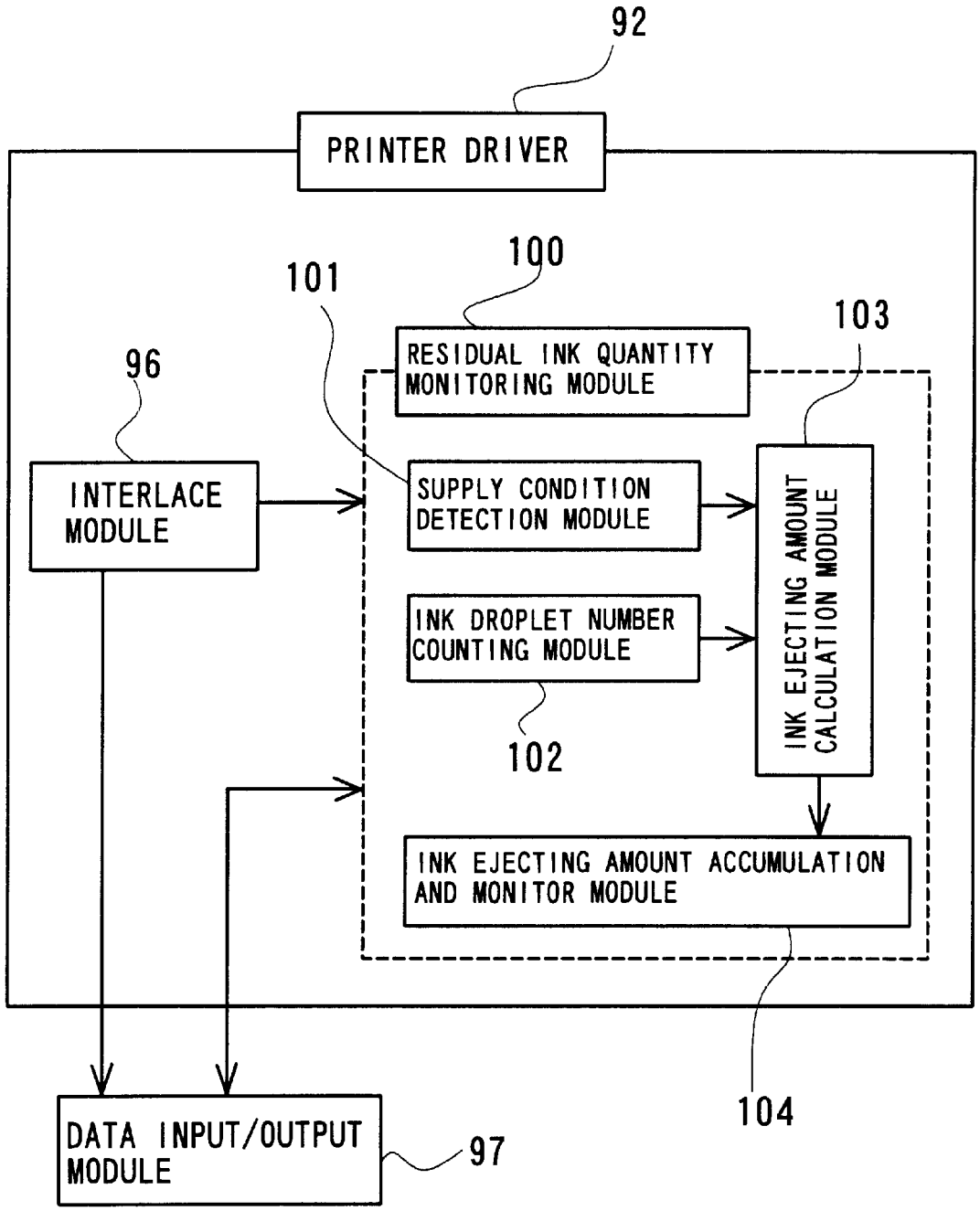
FIG. 13 illustrates the software configuration of a residual ink quantity monitoring module 100 in this embodiment.

FIG. 13 is a block diagram illustrating the connection of the respective modules including the residual ink quantity monitoring module 100. As illustrated in FIG. 13, the residual ink quantity monitoring module 100 transmits data to and from the interlace module 96 and the data input/output module 97, carries out the detection of the ink supply conditions and the count of the number of ink droplets, and outputs the results of monitoring the residual quantity of ink via the data input/output module 97.

The residual ink quantity monitoring module 100 mainly includes four modules, a supply condition detection module 101, an ink droplet number counting module 102, an ink ejecting amount calculation module 103, and an ink ejecting amount accumulation and monitor module 104.

The supply condition detection module 101 detects the ink supply conditions relating to the supply of ink, for example, the temperature of ink, the residual quantity of ink in the ink cartridge, and the dot pattern, which is an arrangement of ink dots formed on the printing medium. The printer of this embodiment detects the ink supply conditions and takes into account the detected ink supply conditions for the calculation of the ejecting weight of ink, thereby improving the accuracy of calculation of the ejecting weight of ink.

The ink droplet number counting module 102 counts the number of ink droplets with respect to each color ejected within a preset time period from each of the ink jet heads 44 through 47. The dot data of the interlace module 96 included in the printer driver 92 (see FIG. 2) is utilized to count the number of ink droplets. The preset time period, in which the number of ink droplets is counted, may be set arbitrarily according to the requirements. In the printer of this embodiment, the preset time period corresponds to the time period of one main scan of the carriage 40.

The ink ejecting amount calculation module 103 multiplies the number of ink droplets counted by the ink droplet number counting module 102 by the weight of a single ink droplet (hereinafter referred to as the ink droplet weight), so as to calculate the ejecting weight of ink. This module 103 accordingly calculates the weight of ink ejected within the preset time period (that is, the time period of one main scan in the printer of this embodiment) with respect to each color. The printer of this embodiment takes into account the ink supply conditions detected by the supply condition detection module 101 for the calculation of the ejecting weight of ink and thereby improves the accuracy of calculation of the ejecting weight of ink. The observed weight of a single ink droplet is written in advance in the memory as a constant in the ink ejecting amount calculation module 103.

The ink ejecting amount accumulation and monitor module 104 accumulates the ejecting weight of ink calculated by the ink ejecting amount calculation module 103 to give a cumulative weight of ink ejection, compares the cumulative weight of ink ejection with a predetermined capacity of the ink cartridge, and displays the residual quantity of ink in a readily understandable form. When the residual quantity of ink is reduced to or below a preset level, an alarm is given to demand replacement of the ink cartridge. The display and the alarm are given via the data input/output module 97. The predetermined capacity of the ink cartridge is written in advance in the memory as a constant in the ink ejecting amount accumulation and monitor module 104. In accordance with one possible modification, the capacity of the ink cartridge may be specified on the CRT of the computer 104. Another possible modification reads the identification label 56 attached to the ink cartridge (see FIG. 5) or reads data electrically recorded inside the ink cartridge to identify the type of the ink cartridge and automatically selects an adequate value corresponding to the result of the identification among a plurality of preset values. When the ink cartridge is replaced and the contact in either the contact switch 71 or the contact switch 72 (see FIG. 10) opens, the ink ejecting amount accumulation and monitor module 104 detects the open contact via the data input/output module 97, resets the cumulative weight of ink ejection, and newly starts accumulation of the ejecting weight of ink.

(2) Details of Residual Ink Quantity Monitoring Process

Figure 14:
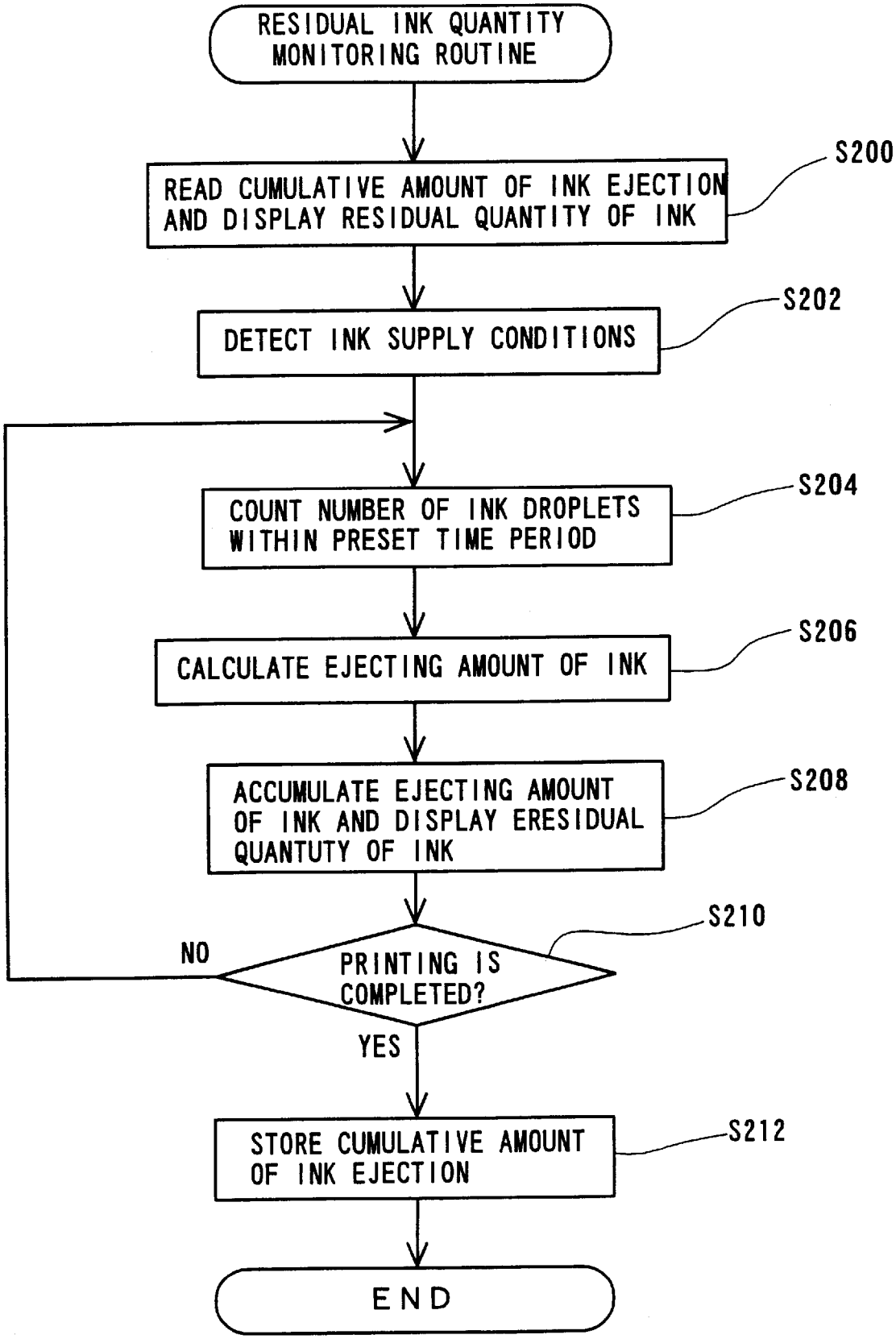
FIG. 14 is a flowchart showing a residual ink quantity monitoring routine executed in this embodiment.

FIG. 14 is a flowchart showing a residual ink quantity monitoring routine executed by the printer of this embodiment. As discussed previously with FIG. 13, the residual ink quantity monitoring module 100 is part of the printer driver 92. Simultaneously with the activation of the printer driver 92 by any one of the various applications programs 91, the residual ink quantity monitoring routine of FIG. 14 is activated to stand ready. Every time the image processing routine allows interruption of the residual ink quantity monitoring routine, the residual ink quantity monitoring process is carried out as discussed below. In this embodiment, the residual ink quantity monitoring module 100 is incorporated in the printer driver 92, and the CPU 81 in the computer 80 executes the processing of FIG. 14. In the case where the residual ink quantity monitoring module 100 is incorporated in the color printer 20 as mentioned previously, the control CPU 61 in the color printer 20 executes the processing of FIG. 14. The following describes the details of the residual ink quantity monitoring process with the flowchart of FIG. 14.

(a) Read Cumulative Amount of Ink Ejection and Display Residual Quantity of Ink (Step S200)

When the program enters the residual ink quantity monitoring routine, the CPU 81 first reads the cumulative weight of ink ejection stored in the RAM 83 at step S200. Each time the program exits the residual ink quantity monitoring routine, the cumulative weight of ink ejection is written in the non-volatile memory for the next cycle of this routine. Immediately after the activation of the routine, the CPU 81 accordingly reads this cumulative value. The color printer 20 of this embodiment uses the four color inks, C (cyan), M (magenta), Y (yellow), and K (black), so that the cumulative weight of ink ejection is stored with respect to each color ink.

Figure 15:
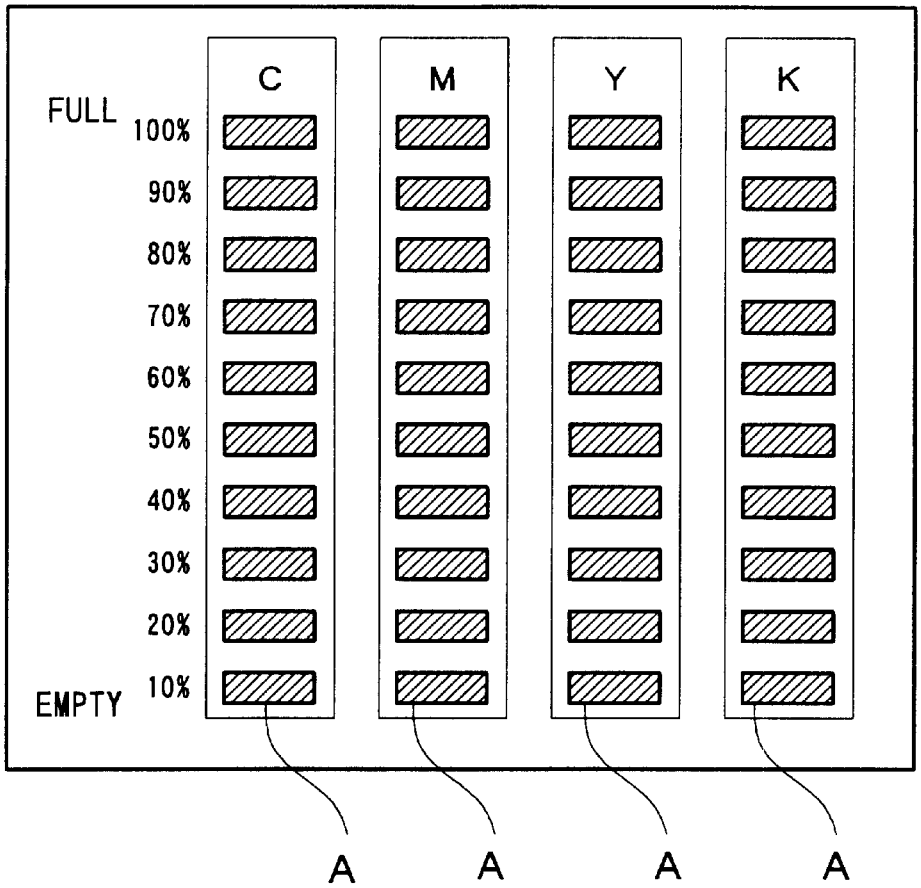
FIG. 15 shows an exemplified display of the residual quantity of ink in the color printer 20 of this embodiment.

After reading the cumulative weight of ink ejection, the CPU 81 compares the input value with the predetermined capacity of the ink cartridge, calculates the residual quantity of ink in the ink cartridge, and displays the calculated residual quantity of ink on the residual ink quantity display panel 58 in the color printer 20. FIG. 15 shows a method of displaying the residual quantity of ink on the residual ink quantity display panel 58. In the printer of this embodiment, the residual quantity of ink is displayed as the ratio to the predetermined capacity of the ink cartridge. The corresponding LED (light-emitting diode) lights green to show the residual quantity of ink. When the difference obtained by subtracting the cumulative weight of ink ejection from the predetermined capacity of the ink cartridge becomes not greater than a preset level, the color of the corresponding LED (A in FIG. 15) changes from green to light to demand replacement of the ink cartridge.

(b) Detect Ink Supply Conditions (Step S202)

After reading the cumulative weight of ink ejection, the CPU 81 detects the ink supply conditions at step S202. The printer of this embodiment detects the temperature of ink, the type of ink, the residual quantity of ink in the ink cartridge, and the dot pattern of ink dots as the ink supply conditions relating to the supply of ink to the ink chamber. The CPU 81 detects all these conditions except the dot pattern at step S202. The temperature of ink is measured with the temperature sensor 37 mounted on the ink jet head 41. The user selects the type of ink among options displayed on the CRT of the computer 80. The residual quantity of ink in the ink cartridge is calculated by subtracting the cumulative weight of ink ejection from the predetermined capacity of the ink cartridge.

The printer of this embodiment detects the ink supply conditions only once every time the printer driver 92 is activated. Since the ink supply conditions are generally considered to change gently, the detection of the ink supply conditions is carried out only on the activation of the printer driver 92, so as to simplify the control procedure. Possible modification causes an interruption at fixed time intervals to detect the variety of ink supply conditions or detects the ink supply conditions for each print page. Such modified structure detects the change of the ink supply condition, for example, even when the temperature of ink changes in the course of printing over a long time period, and thereby further improves the accuracy of calculation of the amount of ink consumption.

(c) Count the Number of Ink Droplets Within Preset Time Period (Step S204)

After the detection of the ink supply conditions, the CPU 81 counts the number of ink droplets ejected within a preset time period with respect to each color ink at step S204. The printer of this embodiment counts the number of ink droplets ejected while the carriage 40 completes one main scan. The color printer 20 creates ink dots of three different sizes, that is, the large, medium, and small ink dots, and the CPU 81 counts the number of ink droplets for each size of the ink dot.

The dot data in the interlace module 96 (see FIGS. 2 and 12) discussed above is utilized to count the number of ink droplets. As described previously, the halftone module 95 converts the image data into the expression form representing the creation or non-creation of the three different types of dots having the different sizes, large, medium, and small. The subsequent interlace module 96 rearranges the converted image data in the sequence of actually creating dots by the ink jet head of each color and expands the rearranged data as dot data on the RAM 83. In the process of counting the number of ink droplets, the CPU 81 reads and counts the dot data, which have been expanded on the RAM 83 by the interlace module 96. In the case where the residual ink quantity monitoring module 100 is incorporated in the color printer 20, the CPU 61 in the color printer 20 may count the dot data output from the data input/output module 97 of the computer 80 (see FIG. 2) as the image data FNL.

(d) Calculate Ejecting Amount of Ink (Step S206)

After counting the number of ink droplets within the preset time period, the CPU 81 multiplies the count by the ink droplet weight (that is, the weight of a single ink droplet) to calculate the ejecting weight of ink at step S206. The ejected ink droplet weight depends upon the ink supply conditions relating to the supply of ink. The processing of step S206 accordingly makes the ink supply conditions detected in advance at step S202 reflect on the calculation and thereby improves the accuracy of calculation of the ejecting weight of ink.

The structure of this embodiment stores in advance the weight of a single ink droplet and multiplies the count of the ink ejecting number by the stored weight to calculate the ejecting weight of ink. One modified structure may store in advance the volume of a single ink droplet and multiply the count of the ink ejecting number by the stored volume to calculate the ejecting volume of ink.

In accordance with a concrete procedure, the printer of this embodiment calculates the ejecting weight of ink by multiplying a correction coefficient, which depends upon the ink supply conditions, as shown by the equation given below:

$$\text{(Ejecting weight of ink)}=\text{(Count of ink droplet number)}\times\text{(Weight of ink droplet)}\times\text{(Correction coefficient)}$$

The (correction coefficient) here is given as $Kt \times Kz \times Kd$, where Kt represents a correction coefficient regarding the temperature of ink (hereinafter referred to as the temperature correction coefficient), Kz represents a correction coefficient regarding the residual quantity of ink (hereinafter referred to as the residual ink quantity correction coefficient), and Kd represents a correction coefficient regarding the dot pattern of ink dots formed on the printing medium (hereinafter referred to as the dot pattern correction coefficient). These correction coefficients depend upon the type of ink. When the type of ink is specified in the printer driver 92, the correction coefficients corresponding to the specified type of ink are automatically selected. The weight of a single ink droplet measured in a predetermined state (that is, the reference state) with respect to each type of dot, large, medium, and small, is stored in advance in the memory. The details of the method of setting the various correction coefficients will be discussed later.

Figure 16A:
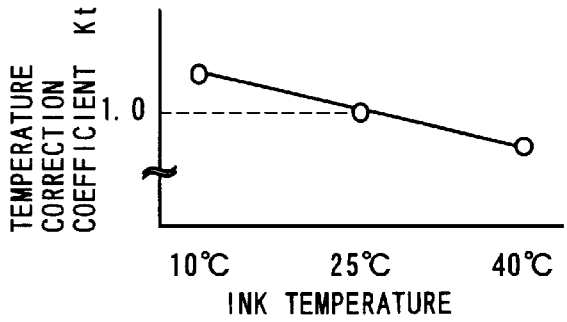
FIG. 16A shows an example of the temperature correction coefficient used in this embodiment.
Figure 16B:
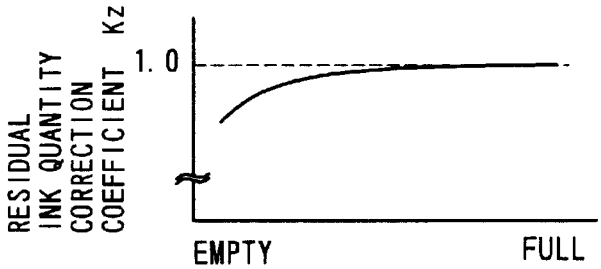
FIG. 16B shows an example of the residual ink quantity correction coefficient used in this embodiment.

In the printer of this embodiment, the temperature correction coefficient Kt and the residual ink quantity correction coefficient Kz are stored on the RAM 83 as map data relating to the temperature of ink and the residual quantity of ink, respectively. Every time the variety of ink supply conditions are detected at step S202, the correction coefficients are updated corresponding to the detected ink supply conditions. FIGS. 16A and 16B respectively show the temperature correction coefficient Kt and the residual ink quantity correction coefficient Kz stored as map data on the RAM 83. Since the weight of a single ink droplet is varied with a variation in temperature of ink or residual quantity of ink, the weight of the ink droplet is corrected with the correction coefficients shown in FIGS. 16A and 16B. The increase in temperature of ink lowers the viscosity of ink and is thus expected to increase the weight of a single ink droplet. As shown in FIG. 16A, however, the temperature correction coefficient Kt of this embodiment is set to decrease the weight of a single ink droplet with an increase in temperature of ink. The reason of such setting will be discussed later.

The dot pattern correction coefficient Kd is selected by the following procedure. The CPU 81 determines whether the dot pattern is a 'solid print pattern' or a 'character print pattern', based on the dot data expanded on the RAM 83 by the interlace module 96. The 'solid print pattern' is an arrangement of dots that mainly appears in the process of printing a natural image and is formed when ink droplets are ejected simultaneously from substantially all the nozzles. The 'character print pattern' is an arrangement of dots that appears in the process of printing a text image and is formed when ink droplets are not ejected simultaneously from all the nozzles. The CPU 81 analyzes the dot data corresponding to one main scan expanded on the RAM 83, determines whether the dot pattern is either the 'solid print pattern' or the 'character print pattern', and selects the corresponding correction coefficient.

One possible modification may provide a greater number of dot patterns, instead of the two dot pattern, and calculate the ejecting weight of ink using the corresponding dot pattern correction coefficient. Another modification may minutely analyze the dot data on the RAM 83 and calculate the dot pattern correction coefficient based on the result of the analysis, in order to further improve the accuracy of calculation of the ejecting weight of ink. This modified method of calculating the correction coefficient will be discussed later.

(e) Accumulate Ejecting Amount of Ink and Display Residual Quantity of Ink (Steps S208 through S212)

After the calculation of the ejecting weight of ink within the preset time period, the CPU 81 adds the result of the calculation to the ejecting weight of ink previously calculated, so as to give a cumulative weight of ink ejection at step S208. Namely the CPU 81 calculates the ejecting weight of ink for every main scan and accumulates the results of the calculation to determine the total weight of ink ejected for each color. The CPU 81 updates the display of the residual quantity of ink based on the cumulative weight of ink ejection thus obtained, and lights the alarm lamp according to the requirements (see FIG. 15).

After the above processing, it is determined whether printing has been completed at step S210. If the printing has not yet been completed, the program returns to step S204 and repeats the subsequent series of processing. If the printing has been completed, on the other hand, the CPU 81 stores the cumulative weight of ink ejection into the non-volatile memory for the next cycle of this routine at step S212. This arrangement ensures the accumulation of the ejecting weight of ink and enables the residual quantity of ink in the ink cartridge to be monitored even after the power supply to the printer is cut off.

Although the weight of ink is used as the value representing the ejecting amount of ink in the above description, the volume of ink may be used instead.

In this embodiment, the temperature correction coefficient Kt is set to decrease the weight of a single ink droplet with an increase in temperature of ink (see FIG. 16A). The following describes the reason of this setting.

Figure 16C:
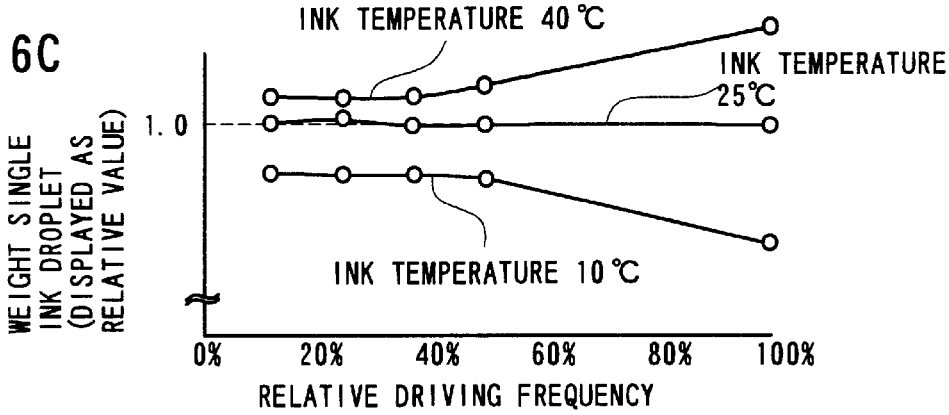
FIG. 16C shows characteristics of the ink droplet weight against the relative driving frequency when the driving waveform is not changed according to the temperature of ink.

FIG. 16C shows variations in weight of a single ink droplet with respect to various temperatures of ink. The relative driving frequency plotted as abscissa of FIG. 16C is one index representing a variety of dot patterns. The higher relative driving frequency increases the ink ejecting number per unit time. The details of the relative driving frequency have been discussed previously. The ink temperature of 25° C. is a standard use temperature of the color printer, so that the color printer 20 is designed to have a fixed weight of a single ink droplet irrespective of the dot pattern at the ink temperature of 25° C. A decrease in ink temperature raises the viscosity of ink and prevents the smooth flow of ink, thereby decreasing the weight of a single ink droplet. The higher relative driving frequency increases the probability of insufficient supply of ink and accordingly decreases the weight of a single ink droplet. The weight of a single ink droplet ejected under the condition of a low ink temperature (at the ink temperature of 10° C. in FIG. 16C) is less than that at the ink temperature of 25° C. in the area of low relative driving frequency and further decreases with an increase in relative driving frequency.

An increase in ink temperature, on the contrary, lowers the viscosity of ink and facilitates the flow of ink, thereby increasing the weight of a single ink droplet. The weight of a single ink droplet ejected at the ink temperature of 40° C. is greater than that at the ink temperature of 25° C. in the area of low relative driving frequency and further increases with an increase in relative driving frequency. This is ascribed to the following mechanism. In the course of ejecting an ink droplet, the pressure in the ink chamber temporarily increases. After the ejection of an ink droplet, the pressure in the ink chamber lowers to cause a new supply of ink to be flown into the ink chamber. The pressure in the ink chamber accordingly repeats the increases and the decrease in the process of ejecting ink droplets. The variation in pressure causes a minute vibration of the interface of ink in the nozzle and a minute flow of ink coming into and out of the ink supply conduit. In the structure that a side wall of the ink chamber is made of a vibrating plate and the deflection of the vibrating plate increases the pressure in the ink chamber, there is a minute vibration of the vibrating plate accompanied by the ejection of ink droplets. The viscosity of ink has the function of attenuating such vibrations and flow. At the standard ink temperature, such minute vibrations thus disappear immediately. At the ink temperature of 40° C., however, the small viscosity of ink causes delayed attenuation of the vibration, which accordingly remains to the timing of ejecting a next ink droplet. When the timing of ejecting a next ink droplet coincides with the phase of the remaining vibration, a large ink droplet is ejected from the nozzle. In this embodiment, when the relative driving frequency is 100%, the timing of ejecting a next ink droplet just coincides with the phase of the remaining vibration and causes a large ink droplet to be ejected from the nozzle.

The characteristics of the weight of a single ink droplet shown in FIG. 16C may cause incomplete solid printing. In the actual operation of the color printer 20, the driving waveform applied to the piezoelectric element PE is changed according to the ink temperature, so as to correct the weight of a single ink droplet. The incomplete solid printing means that a solid area is not completely filled in. The incomplete solid printing results in banding and occasionally causes the ground color of the printing sheet to remain and make white streaks conspicuous. In the case of solid printing, ink dots are created on the whole surface of the printing sheet and the relative driving frequency of 100% is accordingly selected as the printing condition. The excessively small weight of a single ink droplet ejected reduces the size of resulting ink dots and causes the ground color of the printing sheet to remain and make white streaks conspicuous. The excessively large weight of a single ink droplet ejected, on the other hand, increases the size of resulting ink dots and may cause ink dots to undesirably overlap and form a deeper color section, which results in banding. The driving waveform applied to the piezoelectric element PE is thus corrected to fix the weight of a single ink droplet at the relative driving frequency of 100% and thereby stabilize the quality of solid printing.

Figure 16D:
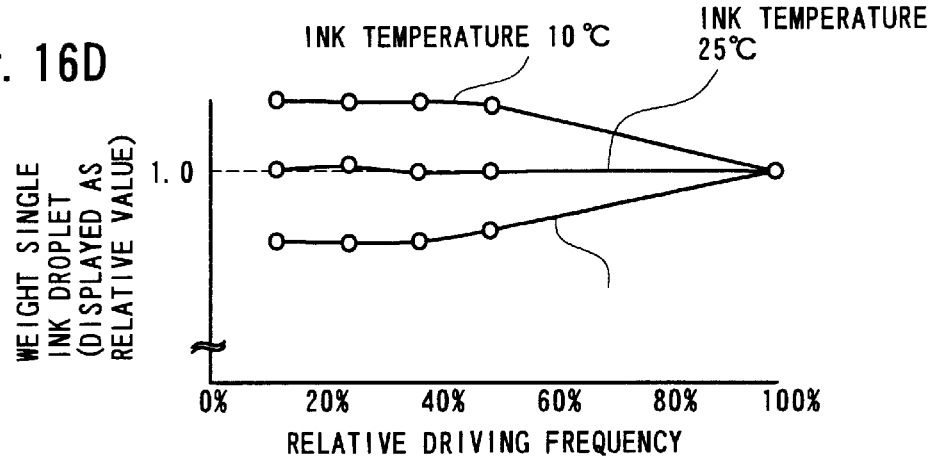
FIG. 16D shows characteristics of the ink droplet weight against the relative driving frequency when the driving waveform is changed according to the temperature of ink.

Because of the above reason, changing the driving waveform according to the ink temperature causes the weight of a single ink droplet in the color printer 20 to have the characteristics shown in FIG. 16D. In order to stabilize the weight of a single ink droplet at the relative driving frequency of 100%, the driving waveform applied to the piezoelectric element PE at the ink temperature of 10° C. causes relatively large ink droplets to be ejected, while the driving waveform at the ink temperature of 40° C. causes relatively small ink droplets to be ejected. The characteristic curve at the ink temperature of 10° C. accordingly displaces upward in parallel from the state of FIG. 16C to the state of FIG. 16D, whereas the characteristic curve at the ink temperature of 40° C. displaces downward in parallel from the state of FIG. 16C to the state of FIG. 16D. The temperature correction coefficient Kt of this embodiment thus decreases with an increase in ink temperature as shown in FIG. 16A.

D. Memory Configuration

Figure 17:
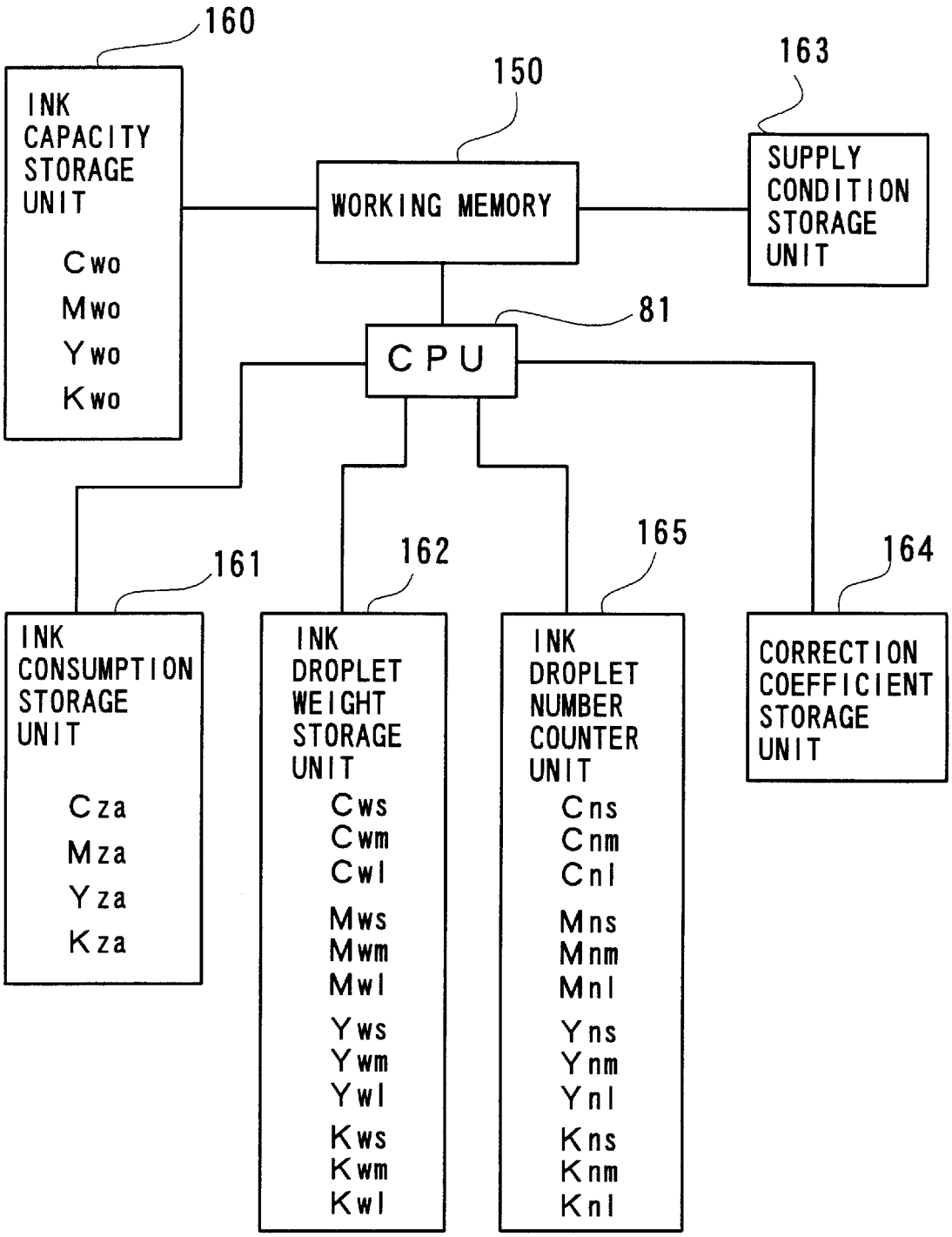
FIG. 17 shows the memory configuration of the residual ink quantity monitoring module 100 in this embodiment.

The memory configuration of the residual ink quantity monitoring module 100 is described briefly with the drawing of FIG. 17. When one of the various applications programs 91 issues a printing instruction, the residual ink quantity monitoring module 100 is activated to specify a variety of areas on the RAM 83 or the hard disk 26. The data explained below are stored in the respective areas under the control of the CPU 81.

A working memory 150 is used to temporarily store the data required for the CPU 81 to carry out a variety of processing operations. The CPU 81 can directly read and write data from and into the working memory 150. An ink capacity storage unit 160 is an area in which the predetermined capacity of a new ink cartridge is stored. The ink capacity storage unit 160 stores ink capacities Cwo, Mwo, Ywo, and Kwo for the respective color inks, C, M, Y, and K. An ink consumption storage unit 161 is an area in which the cumulative weight of ink ejection is stored. The ink consumption storage unit 161 stores amounts of ink consumption Cza, Mza, Yza, and Kza for the respective color inks C, M, Y, and K.

An ink droplet weight storage unit 162 is an area in which the weight of a single ink droplet (the ink droplet weight) ejected under the reference condition is stored. An ink droplet number counter unit 165 is an area in which the counted number of ink droplets is stored. Since the color printer 20 of this embodiment creates three different types of dots having different sizes, that is, large, medium, and small, for each color ink. The weights of a single ink droplet and the counted numbers of ink droplets corresponding to the respective sizes of the respective color inks are stored in the ink droplet weight storage unit 162 and the ink droplet number counter unit 165, respectively. Certain symbols having the following meanings are shown in the ink droplet weight storage unit 162 and the ink droplet number counter unit 165 in FIG. 17. The first capital letters C, M, Y, and K represent the respective color inks C, M, Y, and K. The second small letters w and n represent the weight of a single ink droplet and the number of ink droplets, respectively. The last small letters s, m, and 1 respectively represent the small dot, the medium dot, and the large dot. For example, the weights of a single ink droplet with respect to the large, medium, small dots of the color ink C are expressed by Cwl, Cwm, and Cws. A supply condition storage unit 163 stores a variety of data used to detect the supply conditions. A correction coefficient storage unit 164 stores a variety of correction coefficients. The CPU 81 reads the required data from these storage units to the working memory 150 and executes the variety of processes discussed above. Although these areas are specified on the RAM 83 or the hard disk 26 in this embodiment, a special memory element, such as a RAM, may be provided for each area.

E. Setting Variety of Correction Coefficients

The printer of this embodiment stores a variety of correction coefficients, in order to correct a variation in weight of a single ink droplet according to the difference of the ink supply conditions, such as the temperature of ink, the residual quantity of ink, the type of ink, and the dot pattern on the printing medium. The correction coefficients are set based on the observed ejecting weights of ink. The interlace module 96 may analyze the dot data expanded on the RAM 83 to precisely calculate the dot pattern correction coefficient Kd. The following describes the technique of setting the correction coefficients based on the measurement and the technique of calculating the correction coefficients based on the analysis.

(1) Technique of Setting Correction Coefficients Based on Measurement

Figure 18:
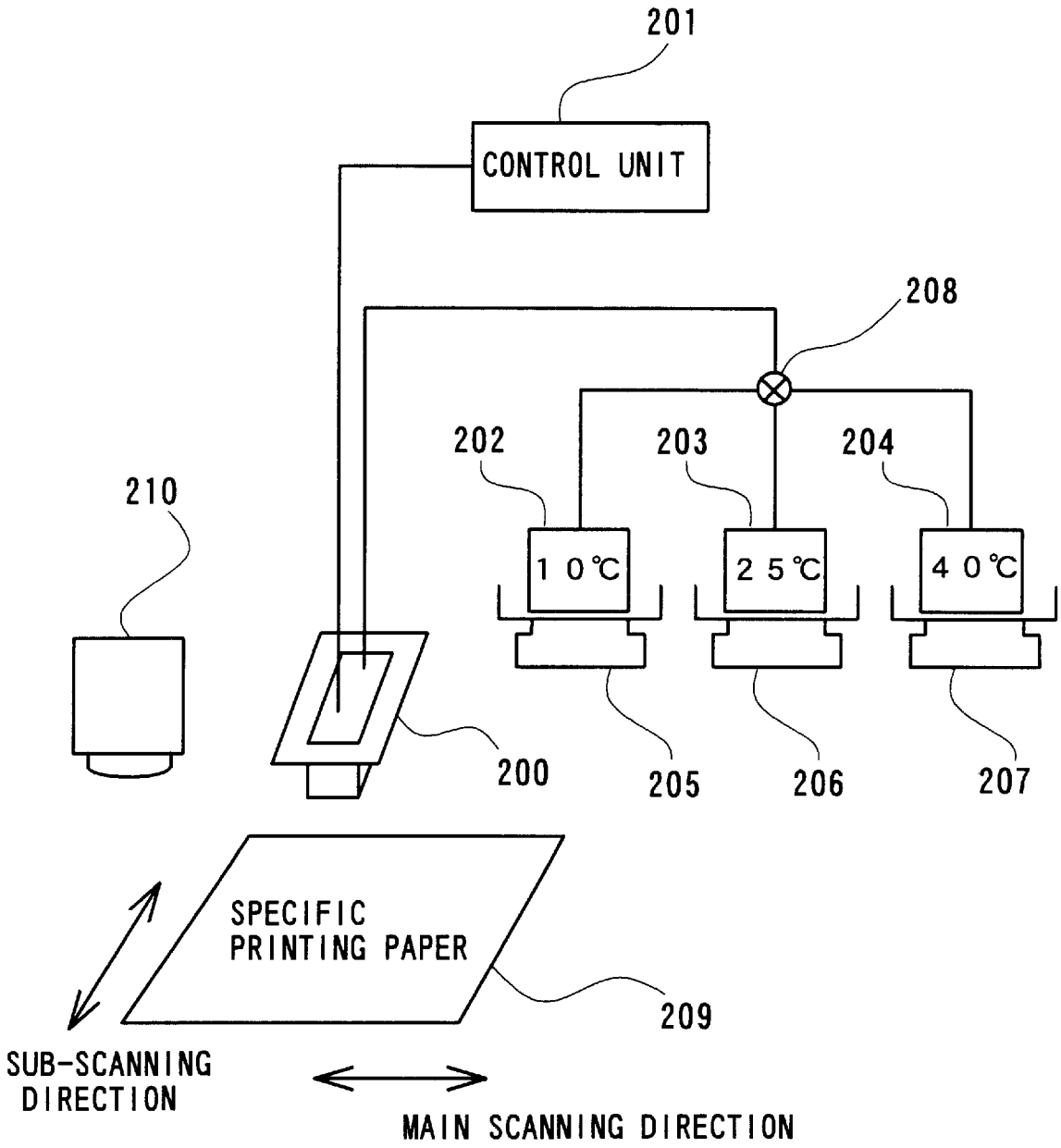
FIG. 18 shows the structure of a measurement apparatus used to determine a variety of correction coefficients in this embodiment.

FIG. 18 conceptually illustrates the structure of an apparatus for measuring the ejecting amount of ink. The measurement apparatus includes a head 200 from which ink droplets are ejected, a control unit 201 that outputs driving signals to the head 200 and controls the head 200, ink cartridges 202 through 204 from which supplies of ink are fed to the head 200, a sheet of specific printing paper 209, and an optical reader 210 that reads the ink density of a printed image or electronic balances 205 through 2207 that measure a decrease in weight of the respective ink cartridges 202 through 204 with high precision. The temperatures of ink in the three ink cartridges 202, 203, and 204 are respectively kept at 10° C., 25° C., and 40° C. The temperature of the ink supplied to the head 200 is changed by operating a switch-over valve 208. The control unit 201 drives the head 200 according to a preset pattern and prints a predetermined image on the specific printing paper 209. In this measurement apparatus, the head 200 can not carry out the main scan and the sub-scan. The specific printing paper 209 is set on a movable stage (not shown), and the predetermined image is printed on the specific printing paper 209 by moving this movable stage in the main scanning direction and in the sub-scanning direction. The control unit 201 also controls this movable stage.

Figure 19:
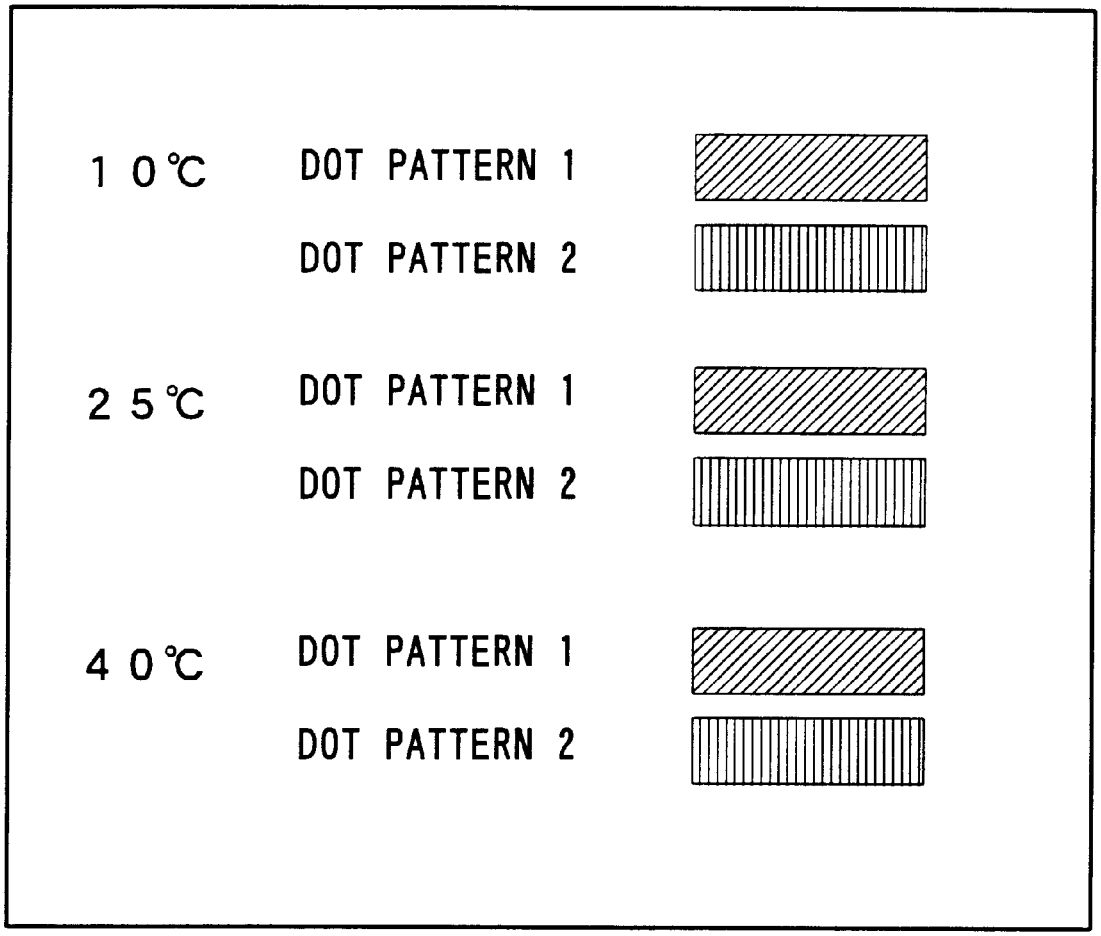
FIG. 19 shows an example of a predetermined image printed on a sheet of specific printing paper in the process of determining the variety of correction coefficients in this embodiment.

An example of the predetermined image printed by the head 200 is shown in FIG. 19. In the illustrated example, the respective images are printed with previously selected two types of dot patterns, that is, a solid print pattern and a character print pattern, at the ink temperatures of 10° C., 25° C., and 40° C. In the example of FIG. 19, there are accordingly six combinations of the ink supply conditions defined by the ink temperature and the dot pattern, and six images corresponding to the six combinations of the ink supply conditions are printed on one sheet of paper. The procedure changes the other ink supply conditions, such as the residual quantity of ink in the ink cartridge and the type of ink, prints the images under the respective combinations of the ink supply conditions shown in FIG. 19, and measures the ink droplet weight under each combination of the ink supply conditions.

Every time printing is completed under a certain condition (precisely, a certain combination of the ink supply conditions), the procedure measures a decrease in weight of the ink cartridge from which a supply of ink is fed, and divides the observed decrease in weight by the number of ink droplets, so as to determine the ink droplet weight, that is, the weight of a single ink droplet, under the certain condition. The number of ink droplets ejected is determined for each predetermined image and measured in advance. The procedure changes the various conditions relating to the ink supply, such as the ink temperature, the type of ink, the residual quantity of ink in the ink cartridge, and the dot pattern formed on the printing sheet, and measures the ink droplet weight under each combination of the ink supply conditions. After the measurement of the ink droplet weight under each combination of the ink supply conditions, the procedure selects and stores one of the combinations of the ink supply conditions as a reference condition (precisely, a reference combination of the ink supply conditions), and calculates the ratio of the ink droplet weight under each of the other conditions to the ink droplet weight under the reference condition, so as to determine the correction coefficient under each condition (precisely, under each combination of the ink supply conditions).

In accordance with another available procedure, the optical reader 210 is used to measure the ink density of a predetermined image printed on the specific printing paper 209 and determine each correction coefficient. As shown in the example of FIG. 19, the image printed by the head 200 has a fixed area, and the ink density of each image is proportional to the ejecting weight of ink. The procedure accordingly measures the ink densities and determines the ratio of the ejecting weights of ink based on the ratio of the ink densities. The use of the specific printing paper is preferable for the measurement of the ink densities, because of the following reason. The optical reader 210 projects a light beam from a reference light source on a printed image and measures the intensity of reflected light from the printed image. The higher ink density of the image raises the dye density on the printing paper and lowers the reflectivity of the printed image. The optical reader 210 thus measures the intensity of reflected light and obtains the reflectivity, in order to determine the ink density. The ink generally includes a variety of solvents, such as an alcohol, other than the dye. The greater ejecting amount of ink makes the surface of printing paper undesirably fluffy due to the effect of the solvents and changes the reflectivity. This may lead to an error in the determination of the ink density. The use of the specific printing paper having a less change in surface condition due to the effect of the solvents is preferable to avoid such an error.

The same correction coefficient, which has been determined in the above manner, may be applied uniformly to all the printers. An alternative arrangement determines a variety of correction coefficients for each ink jet head on its manufacture, prints the correction coefficients on the ink jet head, and stores the correction coefficients into a non-volatile memory in the color printer in the process of attaching the ink jet head to the color printer or stores the correction coefficients into a non-volatile memory provided in the ink jet head. This arrangement does not uniformly apply the same correction coefficient for all the ink jet heads but sets the correction coefficient suitable for each ink jet head, thereby further improving the accuracy of monitoring the residual quantity of ink.

(2) Technique of Calculating Correction Coefficients Based on Analysis

The CPU 81 may analyze the dot data expanded on the RAM 83 by the interlace module 96 and calculate the dot pattern correction coefficient Kd with high precision as discussed below.

Data as shown in FIGS. 20A and 20B are obtained in advance for calculating the dot pattern correction coefficient Kd based on the analysis. FIG. 20A shows the correction coefficients under the respective combinations of the ink temperatures 10° C., 25° C., and 40° C. and the relative driving frequencies of the nozzle 100%, 50%, and not greater than 33%. The relative driving frequency is an index representing the time-based frequency of ejecting ink droplets. The concrete definition of the relative driving frequency is discussed previously. The interpolation equations shown in FIG. 20A are used to calculate the correction coefficients at the ink temperatures other than 10° C., 25° C., and 40° C.

FIG. 20B shows the correction coefficients corresponding to a variety of driving duties of the nozzle. The driving duty is an index representing the ratio of simultaneously ejecting ink droplets from one line of nozzles aligned in the sub-scanning direction (see FIG. 7). The concrete definition of the driving duty is discussed previously. In the example of FIG. 20B, the correction coefficients are set corresponding to eight different conditions, that is, the driving duties of 100% to 13%. The data shown in FIGS. 20A and 20B are experimentally obtained with the measurement apparatus shown in FIG. 18.

Figure 21:
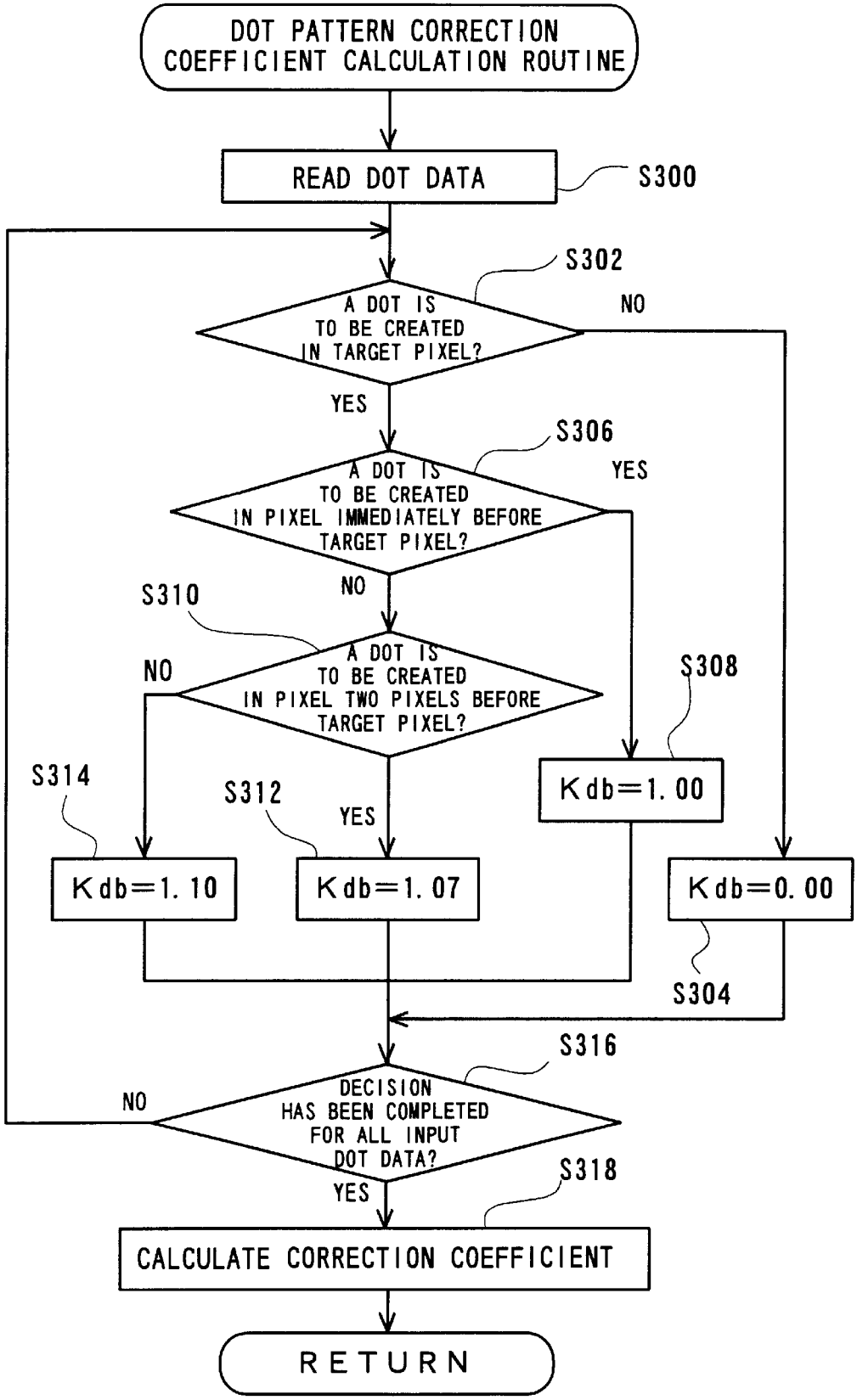
FIG. 21 is a flowchart showing a dot pattern correction coefficient calculation routine executed in this embodiment.

FIG. 21 is a flowchart showing a routine of calculating the dot pattern correction coefficient Kd based on the data of FIGS. 20A and 20B. When the program enters the dot pattern correction coefficient calculation routine, the CPU 81 first reads the dot data expanded on the RAM 83 by the interlace module 96 at step S300. The dot data specifies which of the three different types of dots, large, medium, and small, should be used for each pixel included in an image. Although the processing in the flowchart of FIG. 21 does not specifically differentiate the respective types of dots, large, medium, and small, but is simply based on the creation or non-creation of dots. A preferable modification carries out the processing while differentiating the size of the dot.

After reading the dot data, the CPU 81 determines whether or not a dot is to be created in a target pixel at step S302. In the case where no dot is to be created in the target pixel, a value '0' is substituted into a correction coefficient Kdb at step S304. In the case where a dot is to be created in the target pixel, on the other hand, the CPU 81 then determines whether or not a dot is to be created in a pixel immediately before the target pixel at step S306. When a dot is to be created in the pixel immediately before the target pixel, it is determined that the driving frequency of the target pixel is 100%. A value '1.00' is thus set to the correction coefficient Kdb according to the data of FIG. 20A at step S308. Here it is assumed that the ink temperature is 10° C. When no dot is to be created in the pixel immediately before the target pixel, on the other hand, the CPU 81 determines whether or not a dot is to be created in a pixel two pixels before the target pixel at step S310. In the case where a dot is to be created in the pixel two pixels before the target pixel, it is determined that the driving frequency of the target pixel is 50%. A value '1.07' is accordingly set to the correction coefficient Kdb at step S312. In the case where no dot is to be created in the pixel two pixels before the target pixel, it is determined that the driving frequency of the target pixel is not greater than 33%. A value '1.10' is then substituted into the correction coefficient Kdb at step S314. The CPU 81 then determines whether or not the decision has been completed for all the input dot data at step S316. When the decision has not been completed for all the input dot data, the program returns to step S302 to repeat the processing. When the decision has been completed for all the input dot data, on the contrary, the CPU 81 calculates the dot pattern correction coefficient Kd based on the results of the decision at step S318.

The method of calculating the dot pattern correction coefficient Kd at step S318 is described concretely with the drawings of FIGS. 22A and 22B. FIG. 22A shows an example of dot data input at step S300. The actual dot data have a greater data size than that of the example of FIG. 22A. For convenience of explanation, it is here assumed that the number of nozzles is eight and the number of pixels in the main scanning direction is 16. As mentioned previously, the procedure of this embodiment does not specifically differentiate the size of the dot, and specifies the pixel in which any one of the dots is to be created as the value '1' and the pixel in which no dot is to be created as the value '0'.

The table of FIG. 22B is obtained by determining the driving frequency of each pixel based on the dot data of FIG. 22A and writing the corresponding correction coefficient Kdb in each pixel. At the time of starting the processing of step S318, the CPU 81 obtains such data as shown in FIG. 22B. The bottom of the table in FIG. 22B shows the driving duties. The method of calculating the dot pattern correction coefficient from the driving duty will be discussed later.

When the program starts the processing of step S318 in the flowchart of FIG. 21, the CPU 81 sums up the correction coefficients Kdb with respect to each nozzle position. The sum of the correction coefficients Kdb is, for example, 10.34 with respect to the nozzle position No. 1 and 8.41 with respect to the nozzle position No. 2. The procedure further sums up the sums of the correction coefficients Kdb for the respective nozzle positions. The total sum of the correction coefficients Kdb is 62.16 in the example of FIG. 22B. In the case where no correction is carried out by taking into account the dot pattern, that is, in the case where the correction coefficient Kdb is equal to 1 for all the pixels, the total sum of the correction coefficients is equal to 59, which represents the number of pixels in which a dot is to be created. Consideration of the difference in ejecting amount of ink due to the driving frequency, however, gives the total sum equal to 62.16. The value obtained by dividing the value '62.16' by the number of pixels '59' in which one dot is to be created corresponds to the dot pattern correction coefficient Kd. The processing of step S318 in the flowchart of FIG. 21 calculates the dot pattern correction coefficient Kd in this manner.

In accordance with one possible modification, the processing of step S318 may calculate the dot pattern correction coefficient Kd from the driving duty, instead of the driving frequency. This modified structure determines the driving duty at each serial position (see the bottom data in the table of FIG. 22B) based on the dot data of FIG. 22A. The structure determines the correction coefficient corresponding to each driving duty according to the data of FIG. 20B and calculates the sum of the correction coefficients. The dot pattern correction coefficient Kd is obtained by dividing the calculated sum by the number of pixels in which a dot is to be created.

In accordance with another possible modification, the dot pattern correction coefficient Kd may be calculated from both the driving frequency and the driving duty. The processing of step S318 may implement the calculation according to this modified procedure. The dot data shown in FIG. 22A correspond to the 8 nozzle positions and the 16 serial positions and may thus be regarded as a matrix of 8 rows and 16 columns. A matrix of correction coefficients A based on the driving frequency and a matrix of correction coefficients B based on the driving duty are obtained from this 8×16 matrix. The matrix of correction coefficients A based on the driving frequency includes the correction coefficients Kdb of the corresponding pixels as the elements. For example, as shown in FIG. 22B, the value of the correction coefficient Kdb is equal to '1.1' at the pixel defined by the nozzle position No. 2 and the serial position No. 3. The value of the element at the second row and the third column is accordingly equal to '1.1' in the matrix of correction coefficients A based on the driving frequency. The matrix of correction coefficients A based on the driving frequency accordingly has the size of 8 rows and 16 columns. The matrix of correction coefficients B based on the driving duty includes the correction coefficients obtained from the driving duties of the corresponding serial positions as the elements. For example, the serial position No. 3 has the driving duty of 50% as shown in FIG. 22B. The correction coefficient corresponding to this driving duty is equal to 1.08 according to the table of FIG. 20B. The value of the element at the first row and the third column is accordingly equal to '1.08' in the matrix of correction coefficients B based on the driving duty. The matrix of correction coefficients B based on the driving duty accordingly has the size of 1 row and 16 columns. FIGS. 23A and 23B respectively show the matrix of correction coefficients A based on the driving frequency and the matrix of correction coefficients B based on the driving duty, which are obtained from the dot data of FIG. 22.

The procedure then multiplies the matrix of correction coefficients A by the matrix of correction coefficients B. Since the matrix A has the size of 8 rows and 16 columns and the matrix B has the size of 1 row and 16 columns, it is required to multiply the matrix A by a transposed matrix tB of the matrix B. This gives a columnar matrix of 8 rows and 1 column. The respective elements of this resulting matrix have the values on which correction based on the driving frequency and the driving duty are reflected as shown in FIG. 23C. The procedure sums up the values of the respective elements included in this columnar matrix and divides the sum '66.9' by the number of pixels '59' in which a dot is to be created, so as to obtain the dot pattern correction coefficient Kd.

In the first embodiment discussed above, the dot pattern correction coefficient Kd is selected according to the dot data expanded on the RAM 83. One possible modification analyzes the driving pulses supplied to the piezoelectric elements PE and selects the dot pattern correction coefficient Kd based on the dot data obtained from the result of the analysis.

Another possible modification uses an optical sensor, which directly reads the dot pattern actually formed on the printing medium, and selects the adequate dot pattern correction coefficient Kd based on the results of reading. The following describes such modification as a second embodiment according to the present invention, mainly a difference from the first embodiment.

Referring to FIG. 4, the structure of the second embodiment includes an optical sensor 38 that is attached to the carriage 40 of the color printer 20 and optically measures the intensity of reflected light from the surface of the printing medium. A sheet of paper on which an image is printed is set on the platen 36 of the color printer 20. The carriage 40 is scanned while the sheet of paper is fed little by little by the sheet feed motor 35. The optical sensor 38 attached to the carriage 40 is used to read the image printed on the paper. Namely the color printer 20 functions as a simple scanner. A simple scanner driver 110 shown in FIG. 24 carries out the control of the optical sensor 38. The simple scanner driver 110 transmits data to and from the sheet feed motor 35 and the carriage motor 30 via the printer driver 92 and analyzes the data read by the optical sensor 38 to generate image data.

Figure 24:
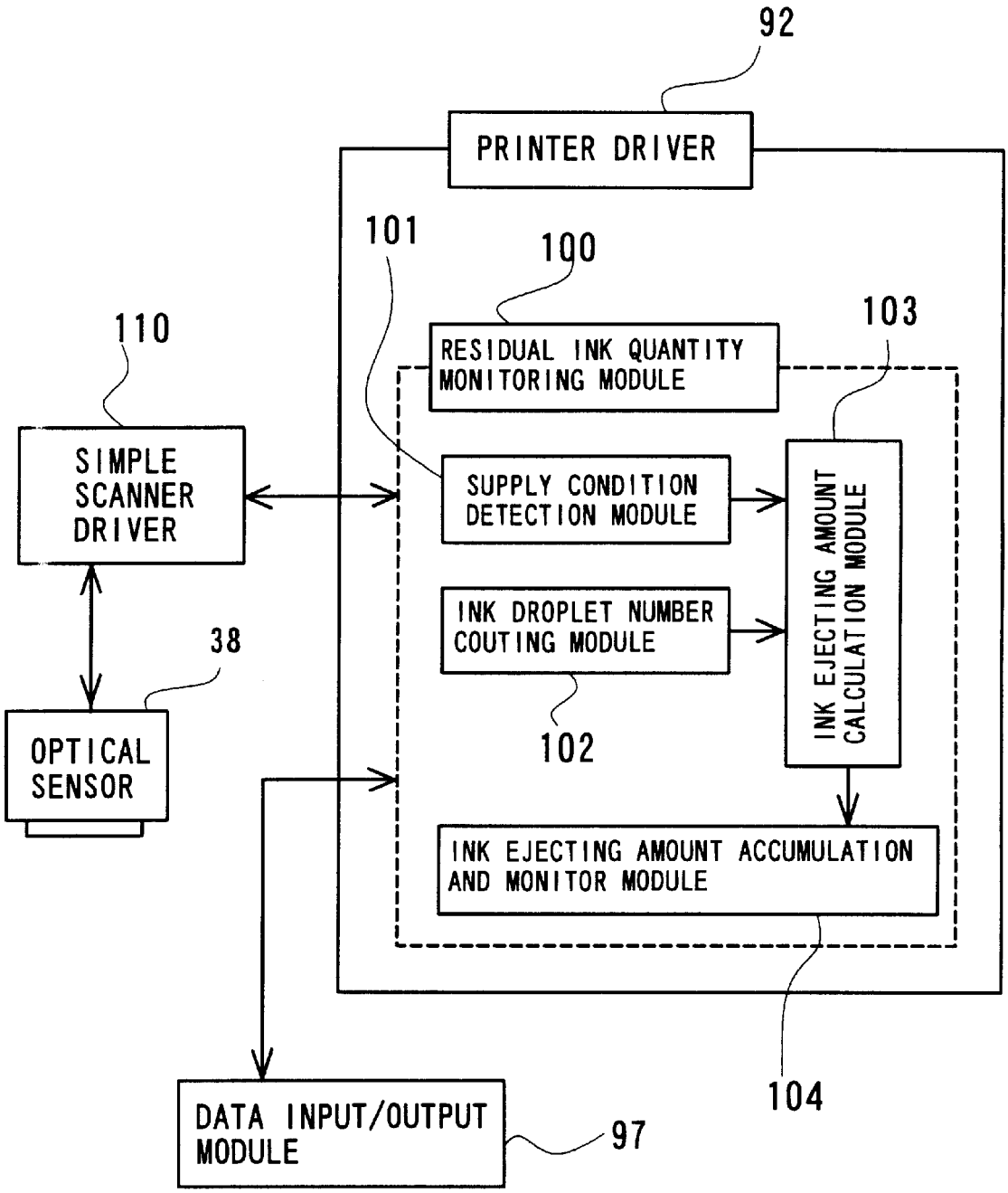
FIG. 24 illustrates a software configuration of the residual ink quantity monitoring module 100 in a second embodiment according to the present invention.

FIG. 24 shows the software configuration of the residual ink quantity monitoring module 100 in the second embodiment according to the present invention. The software configuration of the second embodiment is substantially similar to that of the first embodiment. The main difference is that the residual ink quantity monitoring module 100 of the second embodiment reads the dot pattern data from the simple scanner driver 110, instead of the interlace module 96.

In the structure of the second embodiment, on the activation of the printer driver 92, the simple scanner driver 110 activates in addition to the residual ink quantity monitoring module 100. While the printer driver 92 carries out printing, the simple scanner driver 110 reads the dot pattern on the printing paper. The printer driver 92 occasionally issues an instruction of interruption to the residual ink quantity monitoring module 100 and the simple scanner driver 110. The residual ink quantity monitoring module 100 receiving the instruction of interruption carries out a residual ink quantity monitoring routine similar to that shown in the flowchart of FIG. 14. The simple scanner driver 110 receiving the instruction of interruption, on the other hand, keeps the dot data until completion of the input of the dot data into the residual ink quantity monitoring module 100 and reads the image on the printing paper in parallel in the case of the continuance of printing.

The residual ink quantity monitoring module 100 of the second embodiment selects the dot pattern correction coefficient Kd based on the dot data input in the above manner. This arrangement thus improves the accuracy of calculation of the ejecting weight of ink and enables the residual quantity of ink in the ink cartridge to be monitored with high accuracy.

The structure of the second embodiment includes the optical sensor 38 and thereby enables modification of each correction coefficient in the following manner. The procedure sets a sheet of specific printing paper in the color printer 20 and prints the predetermined image as shown in FIG. 19. The ink density of the predetermined image is measured with the optical sensor 38, and the variety of correction coefficients are determined for each color printer based on the results of the measurement according to the technique discussed with FIG. 18. The series of the processing is carried out by activating a specific applications program 91 and displaying the results of the measurement on the CRT of the computer 80.

As described above, the second embodiment modifies the correction coefficients for each color printer based on the results of the measurement and thus further improves the accuracy of monitoring the residual quantity of ink in the ink cartridge.

Figure 25:
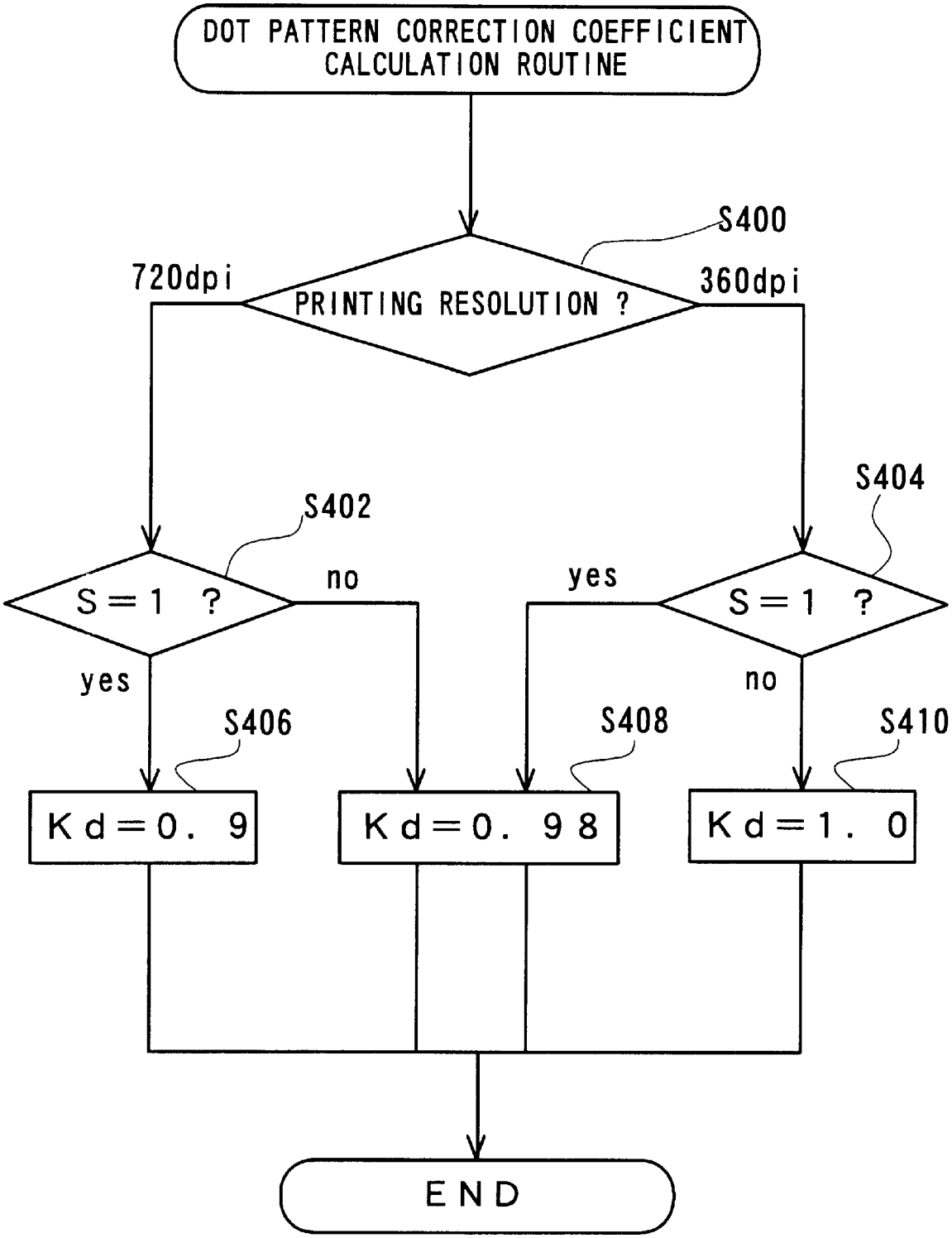
FIG. 25 is a flowchart showing a dot pattern correction coefficient calculation routine executed in a third embodiment according to the present invention.

A simple method discussed below as a third embodiment according to the present invention may be applied to select the dot pattern correction coefficient Kd. FIG. 25 is a flowchart showing a dot pattern correction coefficient calculation routine executed in the third embodiment. When the program enters the dot pattern correction coefficient calculation routine of the third embodiment, the CPU 81 first reads the printing resolution of the color printer 20 at step S400. The color printer 20 of this embodiment may give the priority of printing to either the picture quality or the printing speed, and changes the printing resolution to 360 dpi or 720 dpi based on the selection. Here 'dpi' is a unit of the printing resolution. For example, 360 dpi means that printing is carried out at the resolution of creating 360 dots per inch. The higher printing resolution generally heightens the driving frequency of the nozzle and reduces the ink droplet weight. The processing of step S400 thus determines which of the printing resolutions the color printer 20 is selected for printing.

It is then determined how may main scans are carried out to complete one raster line at step S402 or step S404. As discussed previously, the color printer 20 has the recording mode in which one raster line is printed by a plurality of main scans for the improved printing quality. The color printer 20 also has another recording mode in which the priority is given to the printing speed and one raster line is printed by one main scan. In the recording mode of printing one raster line by a plurality of main scans, the number of ink dots to be created by one main scan is reduced. In the recording mode of printing one raster line by one main scan, on the other hand, the number of ink droplets ejected per unit time period is increased. This tends to reduce the ink droplet weight. There is a significant difference in ink droplet weight between the case of forming one raster line by one main scan and the case of forming one raster line by two main scans. There is, however, an insignificant difference in ink droplet weight between the case of forming one raster line by two main scans and the case of forming one raster line by three main scans. The processing of step S402 or step S404 accordingly determines whether or not one raster line is formed by one main scan (s=1).

In the case where the printing resolution is 720 dpi and one raster line is formed by one main scan, the required ink dots are to be created at a high density by one main scan. This tends to cause an insufficient supply of ink and reduce the size of the ink droplets ejected. The CPU 81 accordingly sets a relatively small value '0.9' to the dot pattern correction coefficient Kd at step S406.

In the case where the printing resolution is 720 dpi and one raster line is formed by a plurality of main scans or in the case where the printing resolution is 360 dpi and one raster line is formed by one main scan, the ejecting frequency of ink droplets is not significantly heightened. A value '0.98', which means that the size of the ink droplets ejected is similar to the standard size, is set to the dot pattern correction coefficient Kd at step S408. In the case where the printing resolution is 360 dpi and one raster line is formed by a plurality of main scans, the lowest ejecting frequency of ink droplets is selected among the possible settings of the color printer 20. A value '1.0', which means that the size of the ink droplets ejected is completely the same as the standard size, is set to the dot pattern correction coefficient Kd at step S410.

The arrangement of the third embodiment calculates the ejecting weight of ink using the dot pattern correction coefficient Kd thus obtained and monitors the residual quantity of ink in the ink cartridge.

The ink jet head 41 in the color printer 20 has a large number of ink ejecting nozzles as shown in FIG. 7. All the nozzles are, however, not always used for printing, but some nozzles have the lower ejecting frequency according to the type of printing. In the nozzles that do not frequently eject ink droplets, the volatile component is released from the ink in the nozzle and the viscosity of the ink increases. In some cases, ink droplets of specific conditions can not be normally ejected from these nozzles. When the color printer does not use for some time, the viscosity of ink in the nozzle gradually increases and prevents ink droplets of the specific conditions from being normally ejected from the nozzle. In worst cases, the nozzle is clogged to eject no ink droplets. When the nozzle is clogged or the ejecting state of the ink droplets has some scatter between the nozzles, the printing quality deteriorates. The color printer 20 is thus designed to carry out head maintenance operations and enable ink droplets to be ejected stably.

The head maintenance operations include a flushing operation, which forcibly ejects ink droplets to force the ink of increased viscosity out of the nozzle, and a cleaning operation, which utilizes a pump used for a supply of ink to suck the ink of increased viscosity out of the nozzle. Ink is consumed in either of the head maintenance operations. The structure of monitoring the residual quantity of ink by taking into account the amount of ink consumption during the head maintenance operations further improves the accuracy of monitoring.

Figure 26:
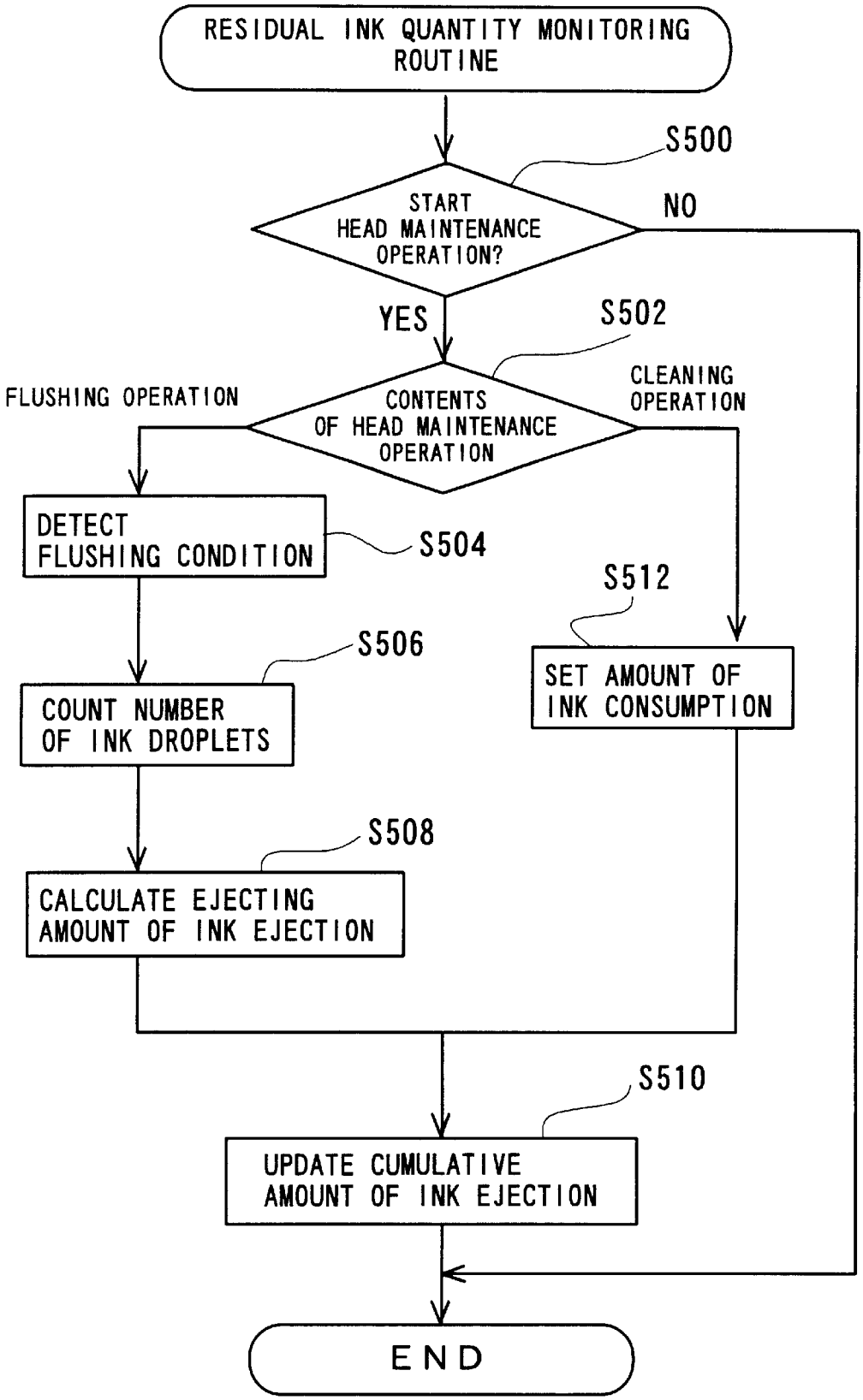
FIG. 26 is a flowchart showing a residual ink quantity monitoring routine executed by taking into account the amount of ink consumption during head maintenance operations.

FIG. 26 is a flowchart showing a residual ink quantity monitoring routine carried out by taking into account the amount of ink consumption during the head maintenance operations. The residual ink quantity monitoring process by considering the ink consumption due to the head maintenance operations is discussed below with the flowchart of FIG. 26.

When the user of the color printer 20 gives an instruction for carrying out a head maintenance operation to the color printer 20 or when the CPU 61 detects fulfillment of a starting condition of the head maintenance operation based on the count of the timer 66 incorporated in the control circuit 60 of the color printer 20, the color printer 20 starts the head maintenance operation and simultaneously issues an instruction of interruption to activate the residual ink quantity monitoring routine shown in the flowchart of FIG. 26. The residual ink quantity monitoring routine carries out the following process while receiving information regarding the head maintenance operation from the color printer 20.

When an interruption is detected to show that the color printer 20 starts the head maintenance operation at step S500, the program determines the contents of the head maintenance operation at step S502. The concrete procedure of step S502 determines whether the head maintenance operation of the color printer 20 is a flushing operation or a cleaning operation. In the case of the flushing operation, a flushing condition is then detected at step S504. The flushing operation of the color printer 20 includes a normal flushing operation, which is carried out to prevent the ejecting state of ink droplets from worsening or carried out when the worsening degree of the ejecting state is not significant, and a power flushing operation, which is carried out when the worsening degree of the ejecting state is significant, for example, when the nozzle is clogged. There is a difference in size of the ink droplets forcibly ejected from the nozzle between the normal flushing operation and the power flushing operation. The processing of step S504 determines which of the flushing operations is to be executed. The program then counts the number of ink droplets ejected during the flushing operation at step S506, and calculates the ejecting weight of ink during the flushing operation from the counted number of ink droplets and the ink droplet weight stored in advance for each flushing condition at step S508. When the ink supply conditions, such as the temperature of ink and the residual quantity of ink in the ink cartridge, have already been obtained on the activation of the printer driver 92, the program corrects the calculated ejecting weight of ink with the variety of correction coefficients, in order to improve the accuracy of calculation of the ejecting weight of ink. After calculating the ejecting weight of ink consumed by the flushing operation, the program updates the cumulative weight of ink ejection at step S510. The concrete procedure of step S510 reads the cumulative weight of ink ejection stored in the non-volatile memory (see steps S200 and S212 in the flowchart of FIG. 14), adds the ejecting weight of ink calculated at step S508 to update the cumulative weight of ink ejection, and stores the updated cumulative weight of ink ejection into the non-volatile memory.

When it is determined that the head maintenance operation is a cleaning operation at step S502, the pump used for the supply of ink is rotated inversely to suck the ink out of the nozzle. The amount of ink consumed by the cleaning operation is fixed in principle for each cleaning operation. The program accordingly sets the amount of ink suction measured in advance for each cleaning operation to the amount of ink consumption at step S512. The program then proceeds to step S510 to read the cumulative weight of ink ejection stored in the non-volatile memory, add the amount of ink consumption obtained at step S510 to update the cumulative weight of ink ejection, and store the updated cumulative weight of ink ejection into the non-volatile memory.

As discussed above, the procedure determines the ejecting amount of ink during the flushing operation or the amount of ink consumption during the cleaning operation and adds the corresponding value to the cumulative amount of ink ejection stored in the non-volatile memory. This arrangement enables the residual quantity of ink to be monitored by taking into account the amount of ink consumed in the course of the head maintenance operations.

The present invention is not restricted to the above embodiments or their modifications, but there may be many other modifications, changes, and alterations without departing from the scope or spirit of the main characteristics of the present invention. By way of example, the software or applications programs realizing the above functions may be supplied to a main memory or an external storage device of a computer system via a communications network, so as to cause the computer to execute the functions.

The scope and spirit of the present invention are limited only by the terms of the appended claims.

What is claimed is:

1. A printer having an ink jet head with plural nozzles that ejects ink droplets and an ink reservoir that has a predetermined capacity to store ink, said ink jet head ejecting ink droplets to create ink dots on a printing medium and thereby print an image on the printing medium, said printer comprising:

a supply condition detection unit that detects an ink supply condition, where the ink supply condition is based on an effect that the ejection of one ink droplet from one nozzle has upon an amount of ink ejected from the remaining nozzles in the ink jet head;

an ink ejecting number counter that counts an ink ejecting number ejected by said ink jet head; and a residual ink quantity monitor that monitors a residual quantity of ink remaining in said ink reservoir by taking into account the ink supply condition detected by said supply condition detection unit, based on the ink ejecting number counted by said ink ejecting number counter and the predetermined capacity of said ink reservoir.

2. A printer in accordance with claim 1, said printer further comprising:

an ink weight storage unit that stores in advance a weight of a single ink droplet ejected from said ink jet head in a specified state of the ink supply condition as a unit amount of ink;

wherein said ink ejecting number counter counts an ink ejecting number within a preset time period as the ink ejecting number, and said residual ink quantity monitor comprises:

a ejecting amount calculation unit that calculates a ejecting amount of ink within the preset time period, based on the ink ejecting number counted by said ink ejecting number counter, the weight of a single ink droplet stored in said ink weight storage unit, and the ink supply condition detected by said supply condition detection unit; and a ejecting amount accumulation unit that accumulates the calculated ejecting amount of ink to give a cumulative amount of ink ejection, said residual ink quantity monitor monitoring the residual quantity of ink remaining in said ink reservoir, based on the cumulative amount of ink ejection and the predetermined capacity of said ink reservoir.

3. A printer in accordance with claim 1, further comprising:

an ink volume storage unit that stores in advance a volume of a single ink droplet ejected from said ink jet head in a specified state of the ink supply condition as a unit amount of ink, wherein said ink ejecting number counter counts the ink ejecting number within a preset time period as an ink ejecting number, wherein said residual ink quantity monitor includes an ejecting amount calculation unit that calculates an ejecting amount of ink within the preset time period, based on the ink ejecting number counted by said ink ejecting number counter, the volume of a single ink droplet stored in said ink volume storage unit, and the ink supply condition detected by said supply condition detection unit, and includes an ejecting amount accumulation unit that accumulates the calculated ejecting amount of ink to give a cumulative amount of ink ejection, and wherein said residual ink quantity monitor monitors the residual quantity of ink remaining in said ink reservoir, based on the cumulative amount of ink ejection and the predetermined capacity of said ink reservoir.

4. A printer in accordance with claim 2, wherein said supply condition detection unit measures temperature of the ink supplied to said ink jet head.

5. A printer in accordance with claim 2, wherein said supply condition detection unit detects a change of a specific condition with time accompanied by the ejection of ink droplets.

6. A printer in accordance with claim 2, wherein said supply condition detection unit detects a specific condition that depends upon a composition of the ink.

7. A printer in accordance with claim 2, wherein said supply condition detection unit detects an amount of ink to be supplied to said ink jet head.

8. A printer in accordance with claim 2, wherein said ink jet head ejects ink droplets while changing a relative position to the printing medium, and said supply condition detection unit detects a preset printing resolution as the ink supply condition.

9. A printer in accordance with claim 2, wherein said ink jet head ejects ink droplets while moving a relative position to the printing medium and thereby forms raster lines as lines of ink dots, and said supply condition detection unit detects a recording mode, which is an index representing a number of relative movements required to complete one raster line, as the ink supply condition.

10. A printer in accordance with claim 2, wherein said supply condition detection unit detects a dot pattern as an array of the ink dots created on the printing medium.

11. A printer in accordance with claim 10, wherein said ink jet head enables simultaneous creation of a plurality of ink dots, and said supply condition detection unit determines whether a number of ink dots created simultaneously fulfills a first recording condition, which is greater than a preset value, or a second recording condition, which is not greater than the preset value, as the dot pattern.

12. A printer in accordance with claim 10, wherein said supply condition detection unit detects an array of the ink dots created on the printing medium by a predetermined optical technique.

13. A printer in accordance with claim 10, said printer further comprising:

a head maintenance unit that carries out a plurality of different types of head maintenance operations that force said ink jet head to eject ink droplets, in order to maintain a ink ejecting state of said ink jet head, wherein said supply condition detection unit detects a type of the head maintenance operation as the ink supply condition.

14. A printer in accordance with claim 2, wherein said supply condition detection unit detects a relative driving frequency, which is an index representing a time-based frequency of ejecting the ink droplets, as the supply condition.

15. A printer in accordance with claim 2, wherein said ink jet heat enables simultaneous creation of a plurality of ink dots, and said supply condition detection unit detects a driving duty, which is an index representing a ratio of a number of ink dots created simultaneously to a number of ink dots that can be created simultaneously, as the supply condition.

16. A printer in accordance with claim 15, wherein the plurality of ink dots that can be created simultaneously by said ink jet head are divided into a plurality of groups, based on a specific condition, said supply condition detection unit detects the driving duty with respect to each group, said ink ejecting number counter and said ejecting amount calculation unit carry out the corresponding processes with respect to each group, and said residual ink quantity monitor sums up the ejecting amount of ink calculated for each group to give a total ejecting amount of ink and accumulates the total ejecting amount of ink, in order to monitor the residual quantity of ink.

17. A printer in accordance with claim 2, said printer further comprising:

a correction coefficient storage unit that stores in advance correction coefficients corresponding to a variety of ink supply conditions, wherein said ejecting amount calculation unit multiplies the ink ejecting number counted by said ink ejecting number counter, the weight of a single ink droplet stored in said ink weight storage unit, and the correction coefficient corresponding to the ink supply condition detected by said supply condition detection unit, so as to calculate the ejecting amount of ink.

18. A printer in accordance with claim 2, wherein said ink jet head enables ejection of at least two different types of ink droplets having different sizes by changing driving signals applied to the nozzles, said ink weight storage unit stores the weight of each type of ink droplet, and said ink ejecting number counter and said ejecting amount calculation unit carry out the corresponding processes with respect to each type of ink droplet.

19. A printer in accordance with claim 2, wherein said ink jet head ejects ink droplets of various colors, so as to create ink dots of the various colors, said ink reservoir stores a predetermined amount of each color ink, and said ink ejecting number counter, said ejecting amount calculation unit, and said residual ink quantity monitor carry out the corresponding processes with respect to each color.

20. A printer in accordance with claim 2, wherein said residual ink quantity monitor gives an alarm when a difference between the cumulative amount of ink ejection and the predetermined capacity of said ink reservoir becomes not greater than a predetermined value.

21. A printer in accordance with claim 2, wherein said residual ink quantity monitor visually informs a user of a ratio of the cumulative amount of ink ejection to the predetermined capacity of said ink reservoir.

22. A printer in accordance with claim 1, said printer further comprising:

an ink weight storage unit that stores in advance a weight of a single ink droplet ejected from said ink jet head in each state of the ink supply condition as a unit amount of ink in each state of the ink supply condition;

wherein said ink ejecting number counter counts an ink ejecting number in each state of the ink supply condition within a preset time period as the ink ejecting number, and said residual ink quantity monitor comprises:

a ejecting amount calculation unit that calculates a ejecting amount of ink within the preset time period, based on the counted ink ejecting number and the unit amount of ink in a detected state of the ink supply condition; and a ejecting amount accumulation unit that accumulates the calculated ejecting amount of ink to give a cumulative amount of ink ejection, said residual ink quantity monitor monitoring the residual quantity of ink remaining in said ink reservoir, based on the cumulative amount of ink ejection and the predetermined capacity of said ink reservoir.

23. A printer in accordance with claim 1, wherein said ink ejecting number counter counts an ink ejecting number within a preset time period as the ink ejecting number, and said residual ink quantity monitor comprises:

an ink ejecting number correction unit that corrects the ink ejecting number counted within the preset time period, based on the ink supply condition detected by said supply condition detection unit; and a corrected ejecting number accumulation unit that accumulates the corrected ink ejecting number to give a cumulative value of the corrected ink ejecting number, said residual ink quantity monitor monitoring the residual quantity of ink remaining in said ink reservoir, based on the cumulative value of the corrected ink ejecting number and a preset value corresponding to the predetermined capacity of said ink reservoir.

24. A method of monitoring a residual quantity of ink remaining in an ink reservoir, said method being applied for a printer having an ink jet head with plural nozzles that ejects ink droplets and said ink reservoir that has a predetermined capacity to store ink, said ink jet head ejecting ink droplets to create ink dots on a printing medium and thereby print an image on the printing medium, said method comprising the steps of:

(a) detecting an ink supply condition, where the ink supply condition is based on an effect that the ejection of one ink droplet from one nozzle has upon an amount of ink ejected from the remaining nozzles in the ink jet head;

(b) counting an ink ejecting number ejected by said ink jet head; and (c) monitoring a residual quantity of ink remaining in said ink reservoir by taking into account the ink supply condition detected in said step (a), based on the ink ejecting number counted in said step (b) and the predetermined capacity of said ink reservoir.

25. A computer program for monitoring a residual quantity of ink remaining in an ink reservoir recorded in a computer readable manner, said program being applied for a printer having an ink jet head with plural nozzles that ejects ink droplets and said ink reservoir that has a predetermined capacity to store ink, said ink jet head ejecting ink droplets to create ink dots on a printing medium and thereby print an image on the printing medium, said program causing a computer to carry out the functions of:

detecting an ink supply condition, where the ink supply condition is based on an effect that the ejection of one ink droplet from one nozzle has upon an amount of ink ejected from the remaining nozzles in the ink jet head;

counting an ink ejecting number ejected by said ink jet head; and monitoring a residual quantity of ink remaining in said ink reservoir by taking into account the detected ink supply condition, based on the counted ink ejecting number and the predetermined capacity of said ink reservoir.

* * * * *